US011896124B2

(12) United States Patent
Chen et al.

(10) Patent No.: US 11,896,124 B2
(45) Date of Patent: Feb. 13, 2024

(54) CONCEALED APPARATUS FOR SLIDABLE PULLOUT MOUNTING AND METHOD OF USE

(71) Applicant: Hardware Resources, Inc., Bossier City, LA (US)

(72) Inventors: Alan Chen, Lewisville, TX (US); Marisa Sanchez, Shreveport, LA (US)

(73) Assignee: Hardware Resources, Inc., Bossier City, LA (US)

( * ) Notice: Subject to any disclaimer, the term of this patent is extended or adjusted under 35 U.S.C. 154(b) by 143 days.

(21) Appl. No.: 17/447,158

(22) Filed: Sep. 8, 2021

(65) Prior Publication Data

US 2022/0061525 A1 Mar. 3, 2022

Related U.S. Application Data

(63) Continuation-in-part of application No. 16/948,016, filed on Aug. 27, 2020, now Pat. No. 11,388,996.

(51) Int. Cl.

| | |
|---|---|
| ***A47B 88/00*** | (2017.01) |
| ***A47B 88/42*** | (2017.01) |
| ***A47B 88/407*** | (2017.01) |
| ***A47B 77/14*** | (2006.01) |
| *A47B 77/18* | (2006.01) |

(Continued)

(52) U.S. Cl.

CPC ..... *A47B 88/42* (2017.01); *A47B 77/14* (2013.01); *A47B 88/407* (2017.01); *A47B 77/18* (2013.01); *A47B 88/473* (2017.01); *A47B 88/956* (2017.01); *A47B 2088/401* (2017.01); *A47B 2088/422* (2017.01)

(58) Field of Classification Search

CPC ..... A47B 77/18; A47B 88/956; A47B 88/407; A47B 2088/401; A47B 77/14; A47B 88/401; A47B 88/42; A47B 88/473; A47B 88/422

See application file for complete search history.

(56) References Cited

U.S. PATENT DOCUMENTS

| | | | |
|---|---|---|---|
| 2,314,157 | A | 3/1943 | O'Brien |
| 2,418,919 | A | 4/1947 | Benson |

(Continued)

FOREIGN PATENT DOCUMENTS

| | | | |
|---|---|---|---|
| EP | 2022370 | A1 | 2/2009 |
| EP | 2476341 | B1 | 7/2014 |

(Continued)

OTHER PUBLICATIONS

Rev-A-Shelf 448KB Cleaning Instructions, Rev-A-Shelf, rev-a-shelf.com, [Document Modified: Feb. 2, 2016 12:53:15].

(Continued)

*Primary Examiner* — Kimberley S Wright

(74) *Attorney, Agent, or Firm* — Schultz & Associates, P.C.

(57) ABSTRACT

A kitchen pullout for storage of knives, miscellaneous utensils and appliances is provided. A reversable base frame and an adjustable top rail is provided to secure the pullout in the cabinet carcass in an extremely stable configuration. The reversable base frame is concealed in the pullout in both a stowed and a deployed position. The bottom slide assembly installable from either the inside or the outside of the cabinet carcass.

21 Claims, 35 Drawing Sheets

(51) Int. Cl.

| | |
|---|---|
| *A47B 88/40* | (2017.01) |
| *A47B 88/956* | (2017.01) |
| *A47B 88/473* | (2017.01) |

(56) References Cited

U.S. PATENT DOCUMENTS

| | | | | |
|---|---|---|---|---|
| 2,839,349 | A | 6/1958 | Culver | |
| 3,423,144 | A | 1/1969 | Patterson | |
| 3,544,182 | A | 12/1970 | Tainter | |
| 4,082,386 | A | 4/1978 | Beasley | |
| 4,305,629 | A | 12/1981 | Friis | |
| 4,960,307 | A | 10/1990 | Nelsen | |
| D333,238 | S | 2/1993 | Stead et al. | |
| 5,655,672 | A | 8/1997 | Stuchlik | |
| D411,718 | S | 6/1999 | Davis et al. | |
| 6,216,888 | B1 | 4/2001 | Chien | |
| 6,769,751 | B1 | 8/2004 | Harbison | |
| D504,054 | S | 4/2005 | Mcguyer | |
| 7,306,301 | B2 * | 12/2007 | Walburn | A47B 88/42 312/334.32 |
| D596,424 | S | 7/2009 | Noe et al. | |
| D621,227 | S | 8/2010 | Connor | |
| 7,775,380 | B2 | 8/2010 | Yang et al. | |
| RE41,725 | E * | 9/2010 | Walburn | A47B 88/42 312/334.32 |
| 7,802,688 | B1 | 9/2010 | Ruan | |
| 7,810,890 | B2 * | 10/2010 | Klein | A47B 88/483 312/334.32 |
| 7,921,524 | B2 | 4/2011 | Maurer | |
| 8,047,621 | B2 * | 11/2011 | Walburn | A47B 88/956 312/265.5 |
| 8,297,722 | B2 * | 10/2012 | Chambers | A47B 88/467 312/334.6 |
| 8,388,076 | B2 * | 3/2013 | Walburn | A47B 88/956 312/265.5 |
| 8,622,493 | B2 | 1/2014 | Roeck | |
| 8,733,865 | B1 | 5/2014 | Chambers et al. | |
| 8,936,225 | B2 | 1/2015 | Bradbury | |
| 8,939,526 | B1 | 1/2015 | Chambers et al. | |
| 9,049,930 | B1 | 6/2015 | Chambers et al. | |
| 9,565,936 | B2 | 2/2017 | Chen et al. | |
| 9,723,922 | B2 * | 8/2017 | Chen | A47B 88/956 |
| 9,730,517 | B2 * | 8/2017 | Youngs | A47B 88/487 |
| 9,756,941 | B1 | 9/2017 | Rowland | |
| 9,848,700 | B2 | 12/2017 | Corless | |
| 10,064,486 | B1 * | 9/2018 | Sun | A47B 88/46 |
| 10,251,480 | B2 * | 4/2019 | Chen | A47B 88/407 |
| 10,499,736 | B2 | 12/2019 | Chen et al. | |
| 10,548,423 | B1 | 2/2020 | Rigas | |
| 10,799,020 | B1 | 10/2020 | Tingle et al. | |
| 11,388,996 | B2 * | 7/2022 | Chen | A47G 21/14 |
| 2004/0084571 | A1 | 5/2004 | Liu | |
| 2006/0001337 | A1 * | 1/2006 | Walburn | A47B 88/42 312/334.27 |
| 2008/0210648 | A1 | 9/2008 | Davis | |
| 2009/0278431 | A1 * | 11/2009 | Walburn | A47B 88/956 312/348.4 |
| 2010/0141106 | A1 * | 6/2010 | Chambers | A47B 88/467 312/334.44 |
| 2012/0049713 | A1 | 3/2012 | Tingle et al. | |
| 2012/0061538 | A1 * | 3/2012 | Walburn | A47B 88/956 29/525.11 |
| 2012/0279935 | A1 | 11/2012 | McNally | |
| 2013/0088134 | A1 | 4/2013 | Varner et al. | |
| 2013/0200765 | A1 | 8/2013 | Foss et al. | |
| 2014/0197121 | A1 | 7/2014 | Knight et al. | |
| 2014/0306584 | A1 | 10/2014 | DeMars | |
| 2016/0128470 | A1 * | 5/2016 | Chen | A47B 88/43 29/434 |
| 2016/0128474 | A1 * | 5/2016 | Chen | A47B 88/493 312/334.44 |
| 2016/0278521 | A1 * | 9/2016 | Chen | A47B 88/42 |
| 2016/0345731 | A1 * | 12/2016 | Youngs | A47B 88/41 |
| 2017/0181542 | A1 | 6/2017 | Corneau | |
| 2017/0234340 | A1 | 8/2017 | Pensak | |
| 2017/0258227 | A1 * | 9/2017 | Chen | A47B 88/43 |
| 2017/0332785 | A1 * | 11/2017 | Chen | A47B 88/43 |
| 2019/0298059 | A1 * | 10/2019 | Chen | A47B 88/994 |
| 2021/0022492 | A1 | 1/2021 | Tingle et al. | |
| 2022/0061524 | A1 * | 3/2022 | Chen | A47B 77/14 |

FOREIGN PATENT DOCUMENTS

| | | | | |
|---|---|---|---|---|
| GB | 2347616 | A * | 10/2018 | A47B 53/02 |
| WO | WO2006069566 | A1 | 7/2006 | |
| WO | WO2015117731 | A1 | 8/2015 | |
| WO | WO2016059573 | A1 | 4/2016 | |

OTHER PUBLICATIONS

Designing for Knife Storage, Part 2: Beyond Knife Blocks and Wall Racks Core77, core77.com, Apr. 29, 2015.

8 inch 'No Wiggle' Utensil Bin Base Cabinet Pullout. UBPO-8SC, Knobs.co, knobs.co, SKU: UBPO-8SC, Apr. 13, 2020.

* cited by examiner

CONCEALED APPARATUS FOR SLIDABLE PULLOUT MOUNTING AND METHOD OF USE

CROSS-REFERENCE TO RELATED APPLICATIONS

This application is a continuation-in-part of U.S. application Ser. No. 16/948,016, filed Aug. 27, 2020. The patent application identified above is incorporated here by reference in its entirety to provide continuity of disclosure.

FIELD OF THE INVENTION

The present disclosure relates to pullout cabinet drawers, in particular, vertical kitchen drawers for storing knives and kitchen utensils.

BACKGROUND OF THE INVENTION

Modern kitchens place premiums on cleanliness, aesthetic appeal and efficient use of space. Closed storage for easy access to cooking utensils, such as knives and cutting boards, promotes efficiency and kitchen cleanliness. But, in the prior art, knives are often stored in butcher blocks on the countertop. Butcher blocks detract from the aesthetic appeal of the kitchen and general cleanliness because they are difficult to clean. Similarly, the prior art provides no centralized method for storing cutting boards or miscellaneous utensils in a concealed and yet easy to clean fashion. Likewise, open air storage canisters for utensils detract from efficiency and aesthetic appearance. Hence, the prior art fails to provide a good kitchen storage solution for knives, cutting boards and miscellaneous utensils.

In an effort to overcome these difficulties, the prior art has responded by creating different types of storage systems. Yet, none of them is completely satisfactory.

For example, U.S. Pat. No. 7,802,688 to Ruan discloses a cutlery storage device with a plurality of separators. Cutlery is carried by a cutlery receiver. Magnets are provided for temporary storage of the cutlery. However, the device is designed to provide only open air storage on a countertop and limits storage to only knives of a certain length.

U.S. Pat. No. 7,306,301 to Walburn discloses a drawer slide system having a front wall, a back wall, a base, and a plurality of shelves. The base is mounted on a horizontally oriented drawer slide and a pair of vertically oriented drawer slides with the movable portion of each slide attached to the base. But, the slides are all positioned at the base of the drawer and so provide limited vertical stability. Installing the drawer slide is also problematic because the movable portion on all three slides must all be aligned with the respective fixed portions which are attached to the bottom of the cabinet. Further, the system fails to provide a way to store miscellaneous utensils.

U.S. Pat. No. 10,251,480 to Chen discloses a pullout for installation in a preexisting cabinet. An adjustable face plate is provided. However, the face plate is difficult to adjust because of the complexity of the adjustment mechanism. The system also fails to provide a provision for storage of miscellaneous utensils.

For these reasons, there is a need for a highly stable pullout which provides a closed storage of various knives, cutting boards and miscellaneous kitchen utensils in a way that promotes kitchen cleanliness, efficiency and aesthetic appeal. There is a further need for an easy method for alignment of the slides with the pullout during installation.

SUMMARY OF THE INVENTION

The current disclosure provides a pullout mechanism for closed secure storage of metallic and ceramic knives, cutting boards, miscellaneous utensils and kitchen appliances.

A storage subassembly provides a number of novel storage features. A fixed sealed magnetic bar is provided to securely suspend metallic knives. The magnetic bar includes a plurality of discrete magnets in an alternating polarity array to maximize the stability of the knives and minimize magnetization of the metallic knives. A removeable liner is positioned below the magnetic bar to aid in cleaning. Storage for ceramic knives is provided by a removable rubber casting having parallel, flexible, serpentine receiving slots, positioned in a fixed drawer surface adjacent the magnetic bar. A removeable liner is positioned below the casting for easy cleaning.

The storage subassembly further provides a plurality of removable canisters for closed storage of miscellaneous utensils positioned conveniently adjacent the magnetic bar.

The pullout mechanism also provides for slots for closed storage of cutting boards adjacent the cannisters.

The storage subassembly further includes a bottom shelf for closed storage of supplies and appliances.

The pullout mechanism further includes a set of novel mounting brackets which provides for stable and yet adjustable mounting of a horizontally oriented top slide. A back bracket mounts the slide to the back wall of the cabinet carcass. A side bracket mounts the top slide to the side wall or face frame of the cabinet carcass. The horizontal oriented top slide greatly increases drawer stability when the pullout mechanism is deployed.

The pullout mechanism further includes a set of adjustable face plate mounting brackets for mounting and aligning the face plate with the surrounding cabinet faces.

The pullout mechanism also provides an adjustable base frame, with a pair of horizontally mounted slides, removably and adjustably attached to the storage subassembly.

In an alternative embodiment, the cabinet pullout includes a plurality of adjustable shelves situation between a fixed pullout top and fixed concealment box. The cabinet pullout includes a recess in the fixed concealment box for concealing a bottom slide assembly when deployed.

The cabinet pullout includes a novel self-contained bottom slide subassembly that is easily mountable from either the inside of the cabinet carcass or outside the cabinet carcass. The bottom slide subassembly also includes a damper system for smooth opening and closing. The bottom slide subassembly also provides an easy method for installing the concealment box without complicated measurements.

The cabinet pullout further includes an adjustable upper slide mechanism to stabilize the top of the cabinet pullout.

BRIEF DESCRIPTION OF THE DRAWINGS

In the detailed description of the preferred embodiments presented below, reference is made to the accompanying drawings.

DETAILED DESCRIPTION OF THE INVENTION

In the description that follows, like parts are marked throughout the specification and figures with the same numerals. The figures are not necessarily drawn to scale, and may be shown in exaggerated or generalized form in the interest of clarity and conciseness.

Figure 1A:
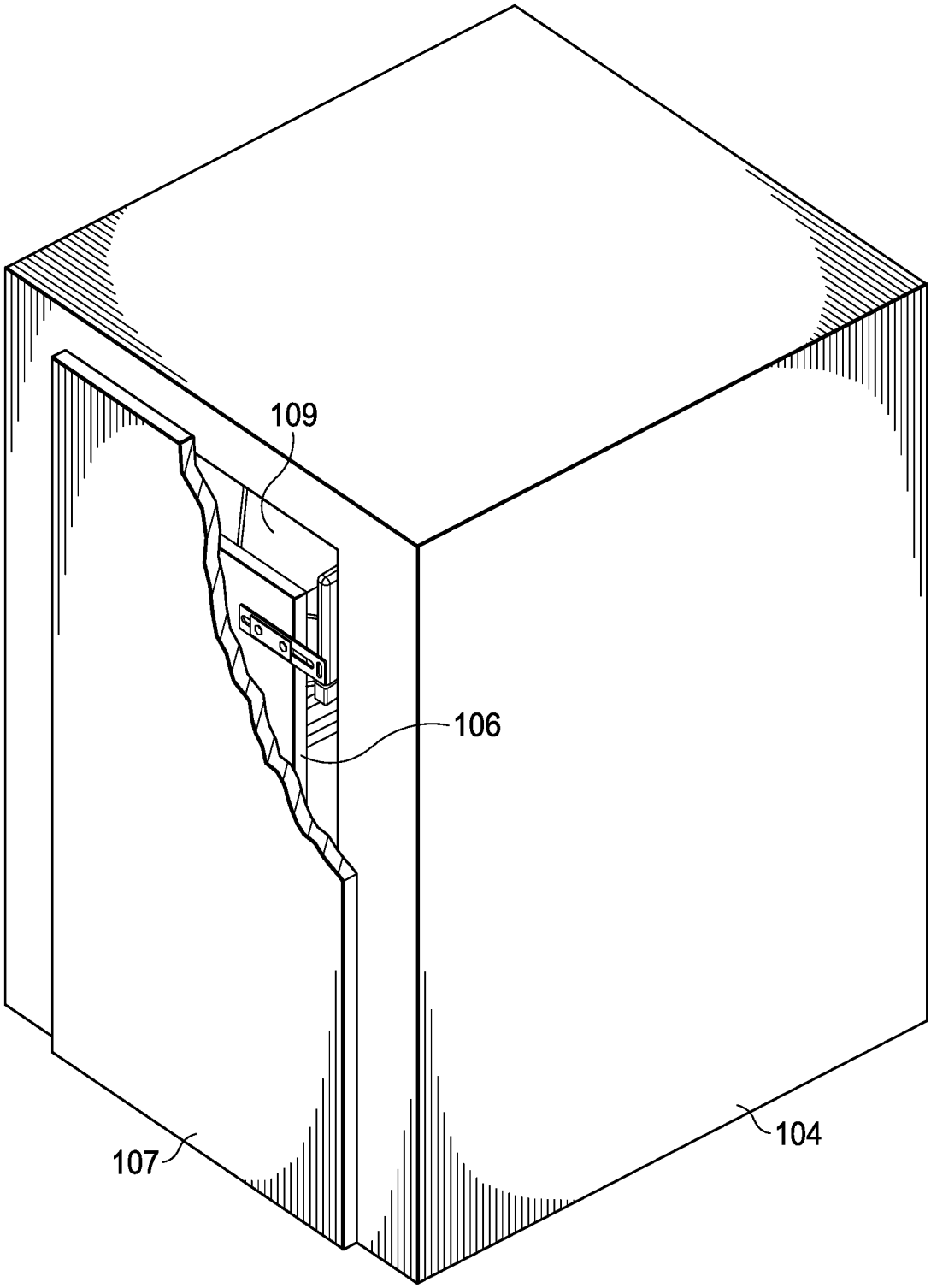
FIG. 1A is a partial isometric view of a kitchen pullout of a preferred embodiment in a stowed position.

Referring to FIG. 1A, kitchen pullout 106 is shown in stowed position centered in opening 109 of cabinet carcass 104.

Figure 1B:
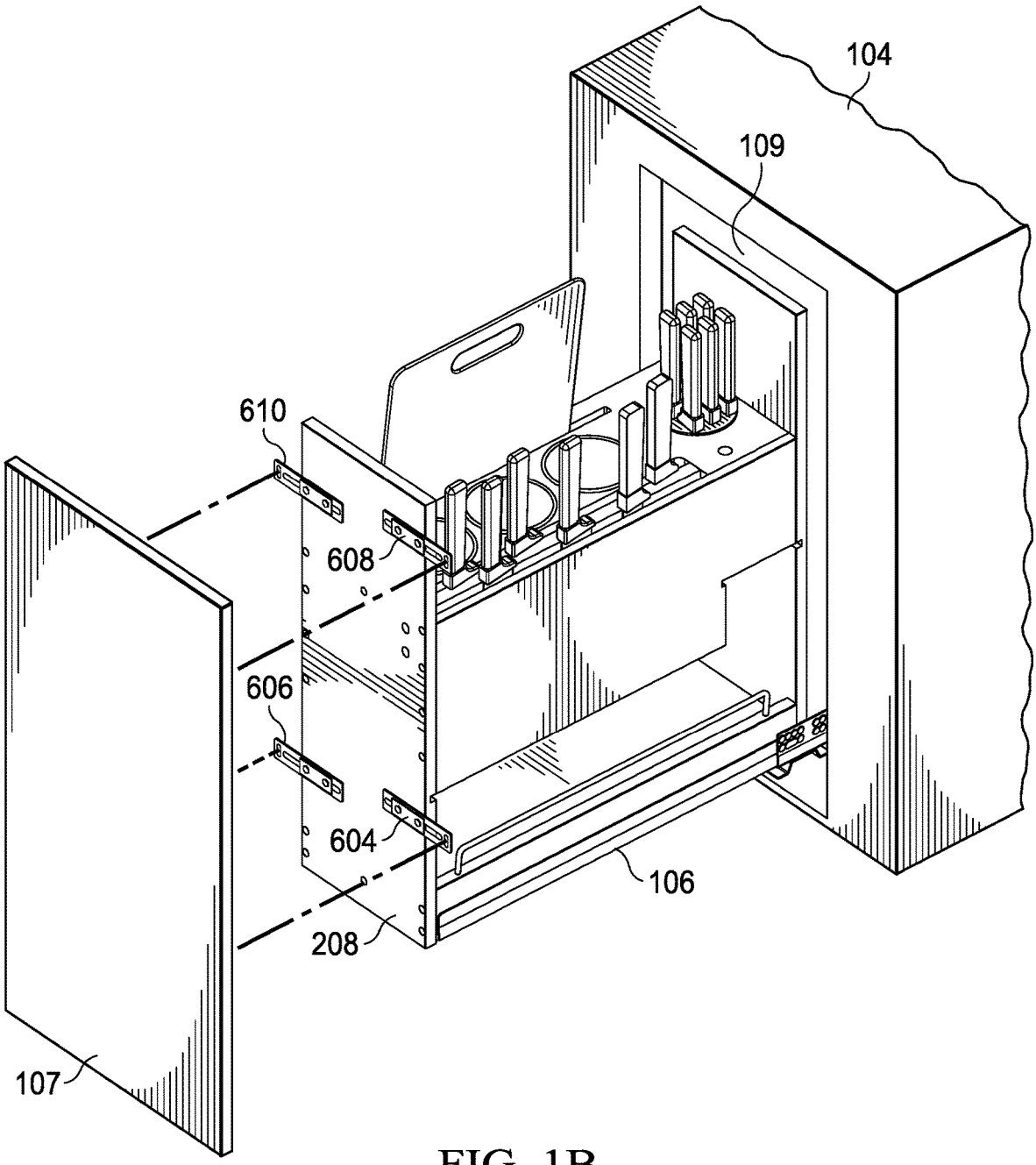
FIG. 1B is an exploded isometric view of a kitchen pullout of a preferred embodiment in a deployed position.

Referring to FIG. 1B, kitchen pullout 106 is shown in a deployed position. Kitchen pullout 106 includes front panel 208. Front panel 208 includes face plate mounting brackets 604, 606, 608 and 610. Face plate 107 is mounted to the face plate mounting brackets, as will be further described.

Figure 2A:
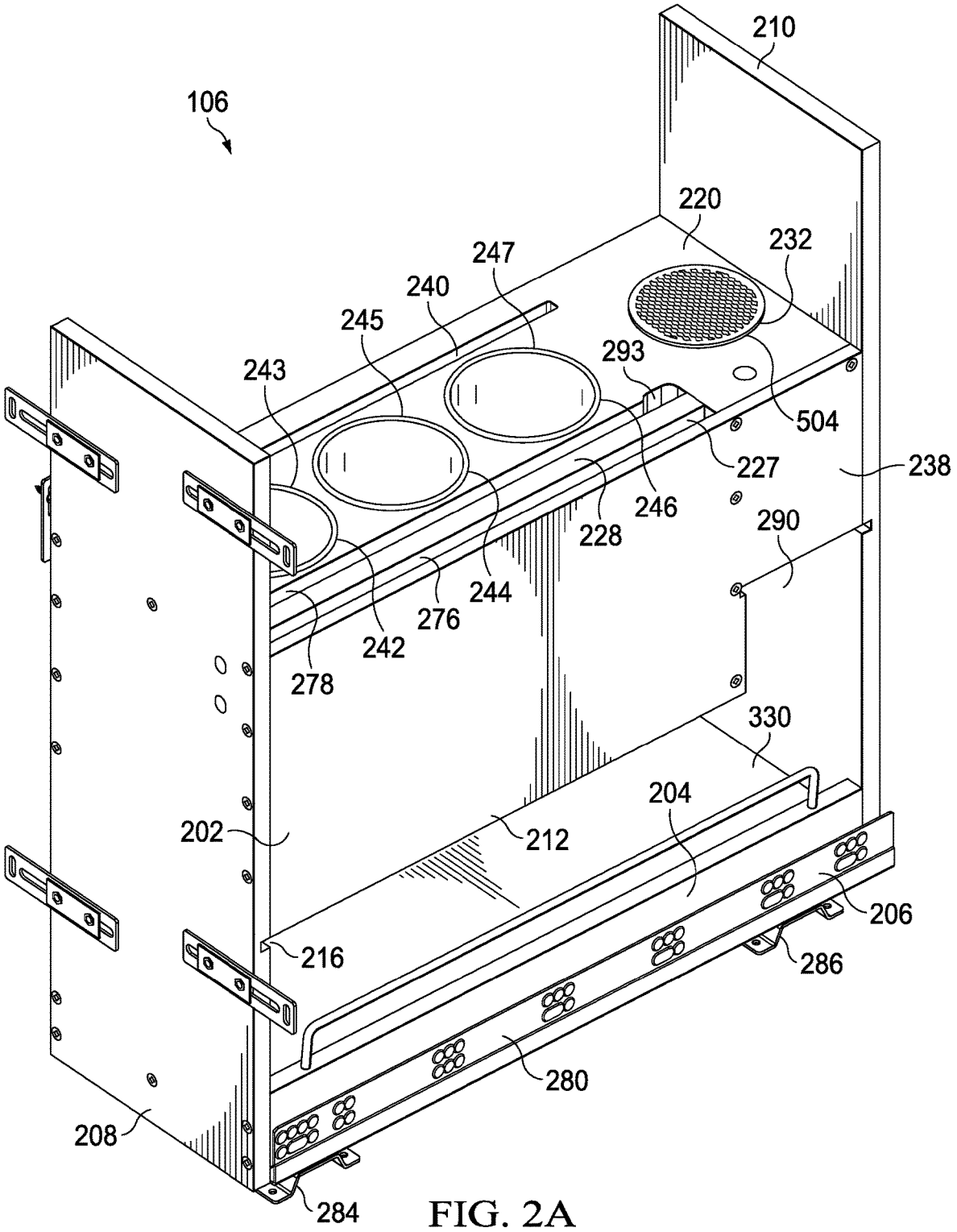
FIG. 2A is an isometric view of a kitchen pullout of a preferred embodiment.
Figure 2B:
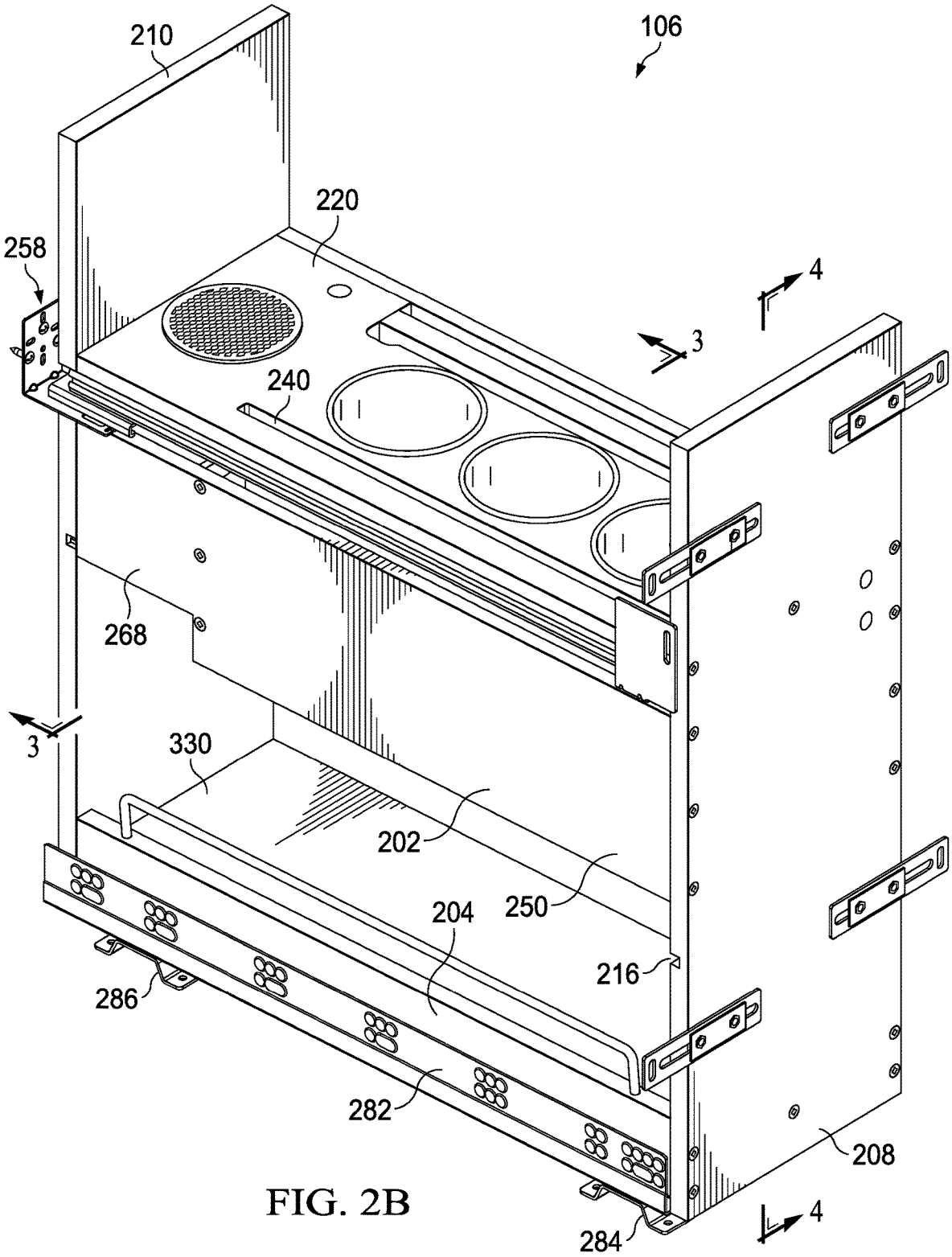
FIG. 2B is an isometric view of a kitchen pullout of a preferred embodiment.

Referring to FIGS. 2A and 2B, kitchen pullout 106 is comprised of front panel 208 and back panel 210. Front panel 208 and back panel 210 are generally rectangular and are generally parallel. Storage subassembly 202, bottom shelf subassembly 204 and bottom slide subassembly 206 are positioned between the front panel and the back panel.

Storage subassembly 202 includes side panel 212, side panel 250 and top shelf 220. Side panel 212 and side panel 250 are generally parallel and generally rectangular and are attached to front panel 208 and back panel 210 by a plurality of wood screws. A suitable industrial adhesive may also be used.

Side panel 212 includes raised rectangular extension 238 forming appliance bay 290. Appliance bay 290 is provided to accommodate large appliances positioned on the bottom shelf, as will be further described. In the preferred embodiment, the height of side panel 212 is between about 12 inches and about 16 inches. The length of the side panel is about 29 inches to about 39 inches. The height of rectangular extension 238 is between about 8 inches and about 10 inches. Of course, other dimensions may be used to accommodate different kitchen utensils and appliances.

Side panel 250 is generally rectangular and includes raised rectangular extension 268. In a preferred embodiment, the height of side panel 250 is between about 7 inches and about 11 inches. The length of side panel 250 is between about 29 inches and about 39 inches. The height of rectangular extension 268 is between about 8 inches and about 10 inches. Of course, other dimensions may be used.

Top shelf 220 is supported by side panels 212 and 250 and is positioned between the front panel and the back panel. Top shelf 220 is generally rectangular and is generally parallel to bottom shelf 330, as will be further described. Top shelf 220 is attached to the side panels, the front panel and the back panel by a plurality of wood screws. A suitable industrial adhesive may also be used.

Top shelf 220 includes slot 240 located proximate top slide subassembly 258. Slot 240 is designed to accommodate flat kitchen appliances such as cutting boards. Top shelf 220 further includes holes 242, 244, and 246 designed to accommodate canisters 243, 245 and 247, respectively. Top shelf 220 further comprises hole 232. Rubber retainer 504 is positioned in hole 232. The rubber retainer is adapted to secure a plurality of ceramic knives, as will be further described. Top shelf 220 further includes a slot 227. Slot 227 is designed to accommodate magnetic bar 228. Magnetic bar 228 is positioned within slot 227, adjacent slots 276 and 278. Slots 276 and 278 are adapted to secure metallic knives of varying lengths against the magnetic bar, as will be further described. Slot 278 further comprises flair 293. Flair 293 is provided to accommodate a honing rod.

Figure 3:
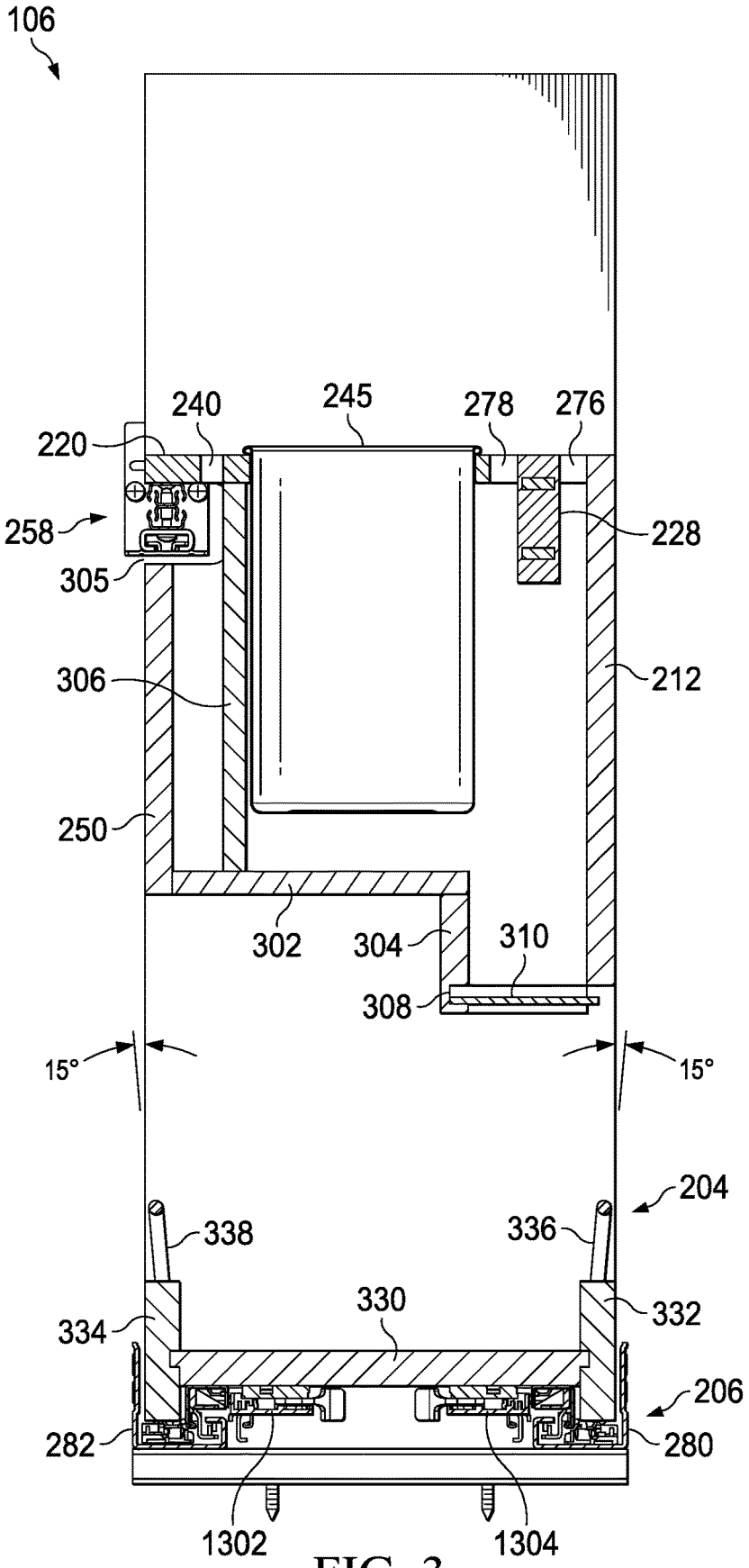
FIG. 3 is a cross-sectional view of a kitchen pullout of a preferred embodiment.

Referring also to FIG. 3, bottom panel 302 is rigidly attached to each of the front and back panels and side panel 250. Vertical support panel 306 is connected between the top shelf and the bottom panel and provides support for top shelf 220. Mounting bay 305 is formed adjacent top shelf 220 and above side panel 250, to accommodate top slide subassembly 258, as will be further described.

Support riser 304 is attached to each of the front and back panels and bottom panel 302. Support riser 304 provides vertical support for bottom panel 302. Horizontal slot 308 is provided in support riser 304. Liner 310 fits within slot 308. Liner 310 is located below the magnetic bar. Liner 310 is removeable from slot 308 for cleaning. Liner 310 is preferably a Teflon® or polycarbonate sheet approximately ¼ inch in thickness.

Bottom shelf subassembly 204 extends between front panel 208 and back panel 210 below the storage subassembly. Bottom shelf subassembly 204 is attached to the front and back panels by a plurality of wood screws. Bottom shelf subassembly 204 includes bottom shelf 330. Bottom shelf 330 is attached to each of bottom shelf walls 332 and 334 by suitable screws or adhesive. Side rail 336 is attached to shelf wall 332. Side rail 338 is attached to bottom shelf wall 334. In a preferred embodiment, each of the side rails is a polished drawn steel wire of about 5 mm in diameter. Preferably, the side rails are each attached at an angle of about 15° from vertical, oriented outwardly from the center of the mechanism. The outwardly facing mounting angles of the side rails are important to assist in access to appliances stored on the bottom shelf.

Bottom shelf subassembly 204 is supported by bottom slide subassembly 206. Bottom slide subassembly 206 includes telescoping drawer slides 280 and 282. The slides are operatively and removably attached to bottom shelf 330 by undermount slide connectors 1304 and 1302, as will be further described. Front base bracket 284 and rear base bracket 286 are transversely mounted to drawer slides 280 and 282. The front base bracket and the rear base bracket attach the slides to the floor of the cabinet carcass and elevate the kitchen pullout to clear any face frame installed on the cabinet carcass.

Figure 4:
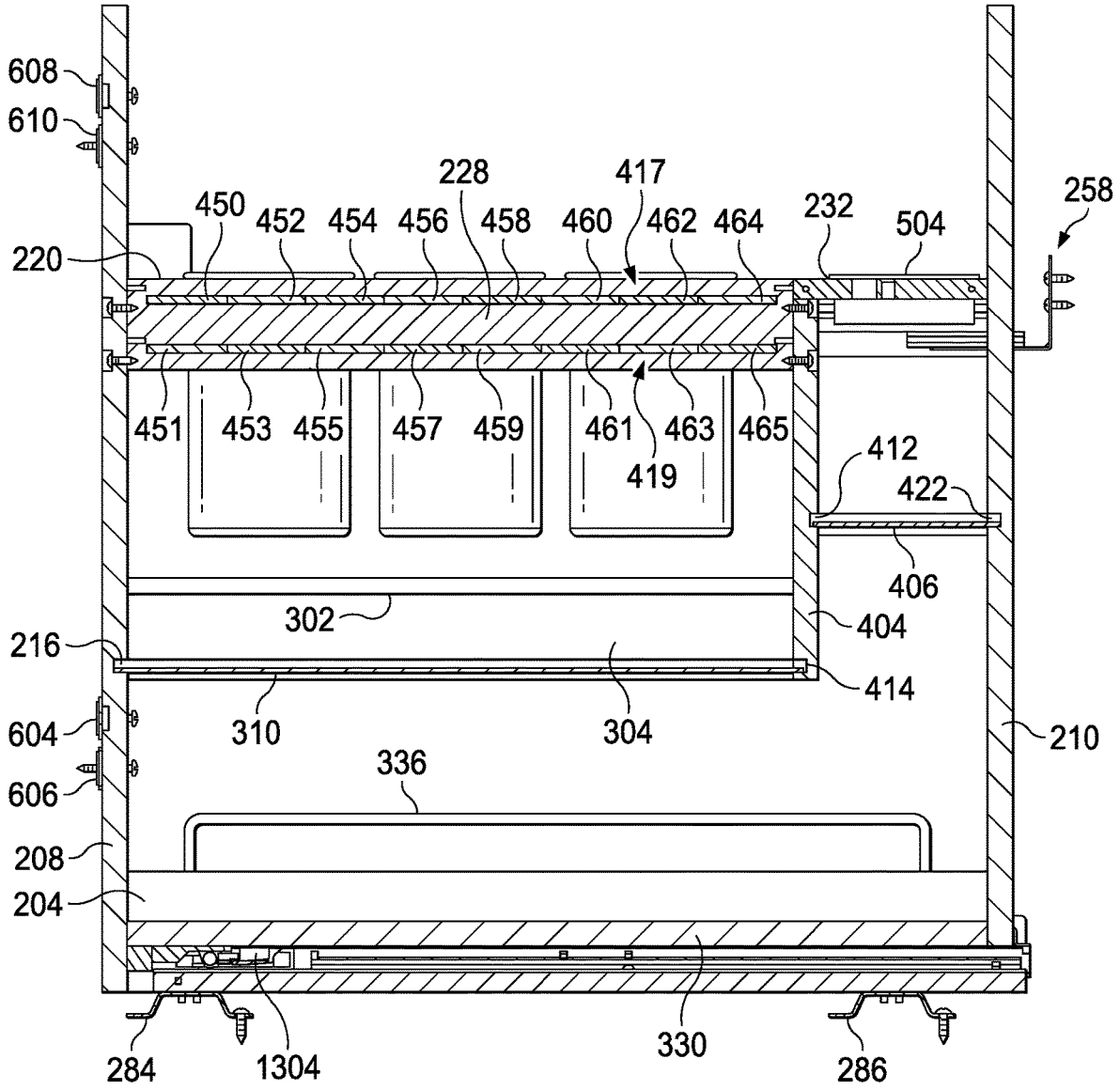
FIG. 4 is a cross-sectional view of a kitchen pullout of a preferred embodiment.

Referring also to FIG. 4, divider 404 is attached to top shelf 220 adjacent the magnetic bar and forms a vertical support for the magnetic bar and the top shelf. The divider extends across the width of the top shelf and is attached to the side panels. Divider 404 includes slot 414 which extends laterally along the width of the divider. Slot 414 is aligned with slot 216 on front panel 208. Slots 216 and 414 are aligned to accommodate liner 310 which is supported at either end by the slots and is removable for cleaning. Divider 404 further includes slot 412 which extends laterally opposite slot 422 on the back panel. Slots 412 and 422 accommodate liner 406 which is removably supported on either side by the slots for cleaning.

Magnetic bar 228 is attached between front panel 208 and divider 404 with screws or a suitable industrial adhesive. Magnetic bar 228 is preferably comprised of two longitudinal, generally parallel magnet rows 417 and 419. Magnet row 417 comprises magnets 450, 452, 454, 456, 458, 460, 462 and 464. Magnet row 419 comprises magnets 451, 453, 455, 457, 459, 461, 463 and 465. Each magnet row is positioned to be nearly adjacent the outwardly facing surfaces of the magnetic bar, as will be further described. In a preferred embodiment, the magnets are discrete, rectangular, high density neodymium magnets, arranged in an alternating polarity array, as will be further described.

Figure 5:
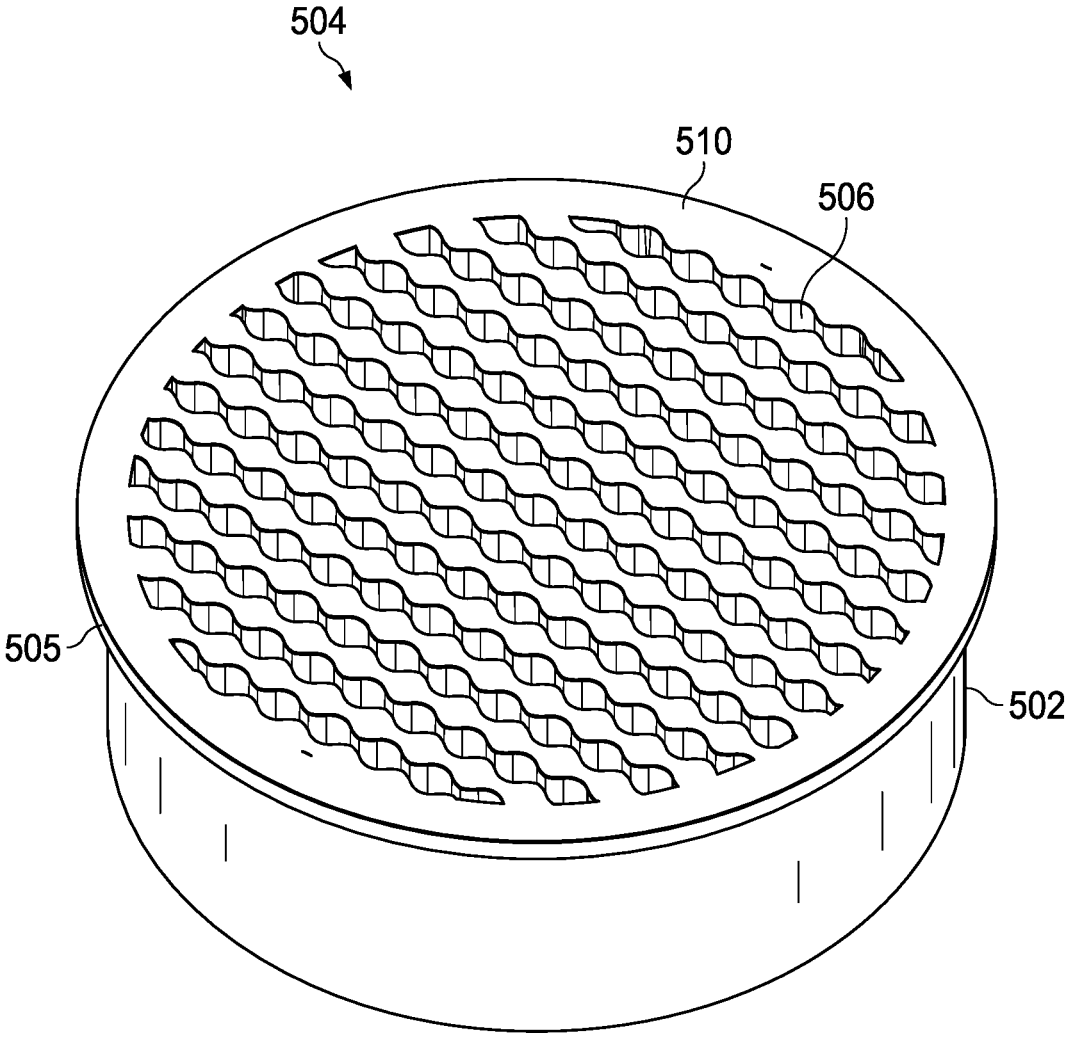
FIG. 5 is an isometric view of a ceramic knife retainer of a preferred embodiment.

Referring to FIG. 5, rubber retainer 504 is comprised of cylindrical side wall 502 and retainer surface 510. In a preferred embodiment, the side wall and retainer surface are integrally formed of a flexible rubber or neoprene casting. Rubber retainer 504 further comprises a plurality of generally parallel serpentine slots 506. The serpentine slots are, on average, about ⅛ inches wide. The serpentine slots allow for various placements of metallic knives and ceramic knives. Side wall 502 is positioned within hole 232. Flange 505 is positioned on the top shelf adjacent hole 232 and above liner 406. Rubber retainer 504 is removable from hole 232 so as to be washable.

Figure 6:
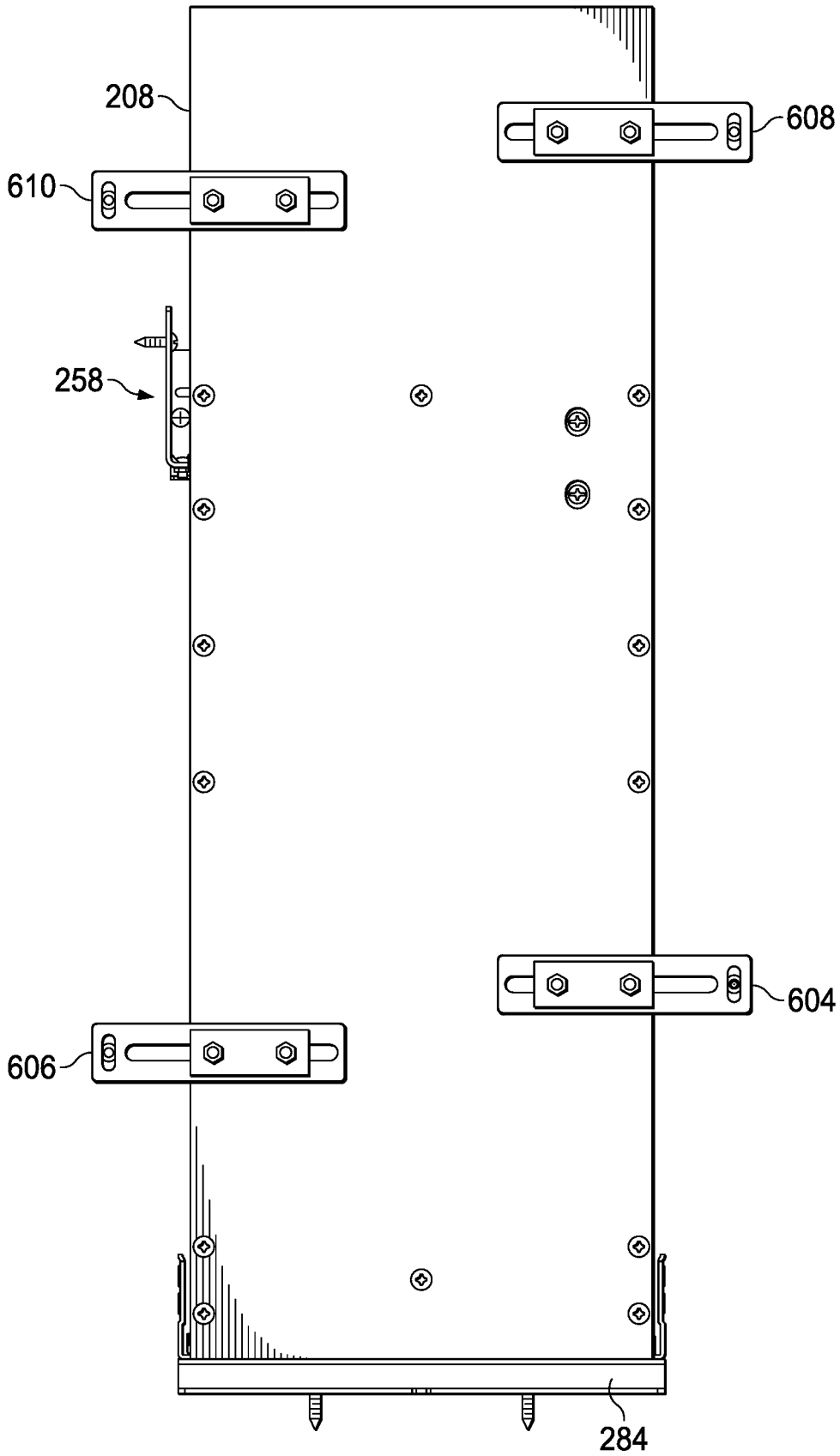
FIG. 6 is a front view of a kitchen pullout of a preferred embodiment.

Referring to FIG. 6, front panel 208 includes face plate mounting brackets 604, 606, 608, and 610. Face plate 107 is attached to the mounting brackets by wood screws or a suitable industrial adhesive. The face plate mounting brackets are adapted to allow lateral adjustment of face plate 107 so as to align it with the cabinet carcass. Details of the face plate mounting brackets and their adjustment are described in U.S. Pat. No. 10,251,480 to Chen, which is incorporated herein by reference in its entirety.

Figure 7:
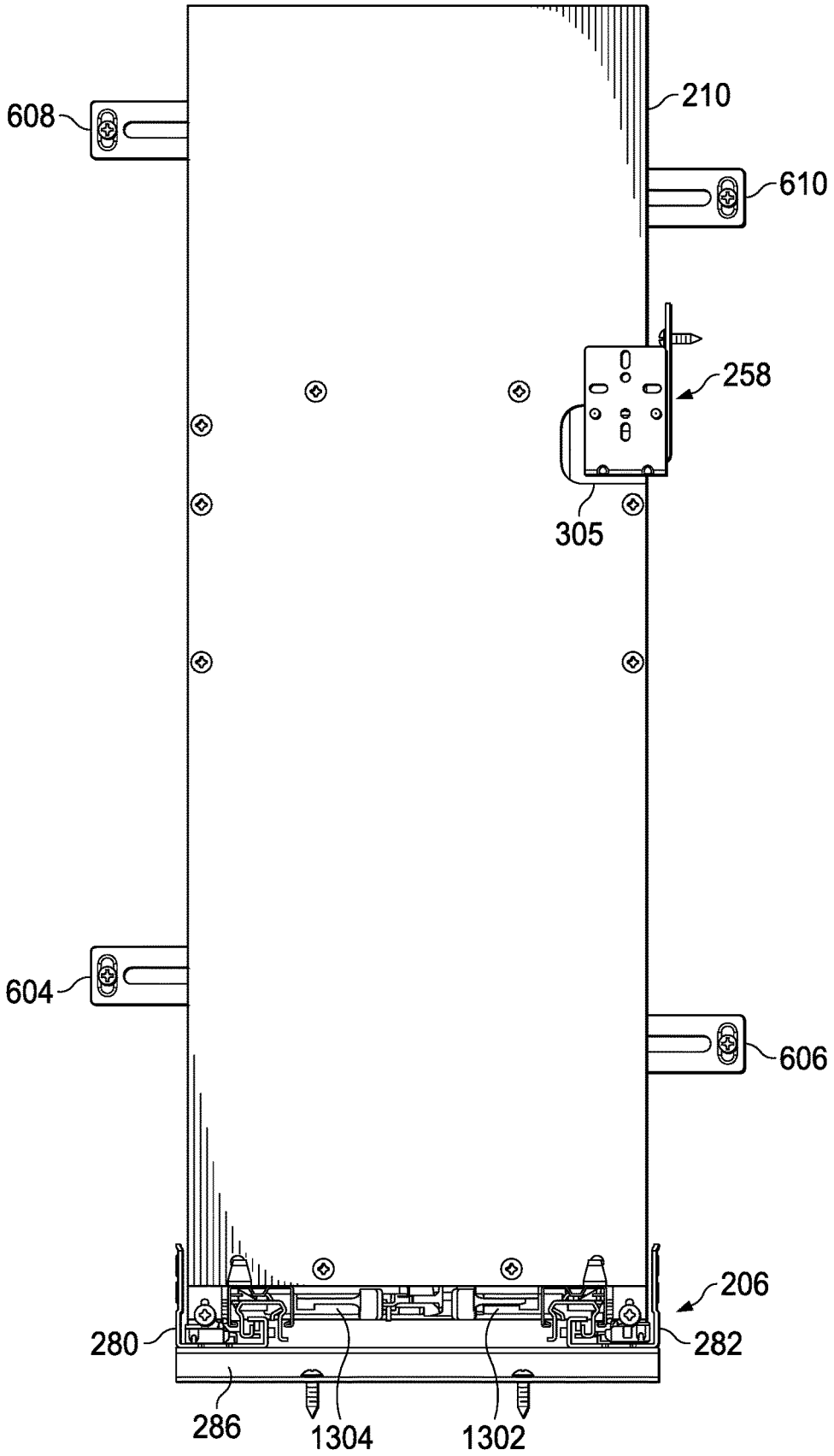
FIG. 7 is a back view of a kitchen pullout of a preferred embodiment.

Referring to FIG. 7, back panel 210 is generally rectangular. The back panel is attached to the top shelf, the bottom shelf and the side panel by a plurality of screws. Alternatively, an industrial adhesive may suffice. Back panel 210 further comprises mounting bay 305. Mounting bay 305 is a substantially square longitudinal recess formed in the back panel that accommodates the top slide subassembly, as will be further described. Bottom slide subassembly 206 is attached at the base of the bottom panel, as previously described.

Referring to FIGS. 8A, 8B, 8C and 8D, top slide subassembly 258 includes top drawer slide 803. Top drawer slide 803 is further comprised of upper rail 802 and lower rail 804. Upper rail 802 is engaged with lower rail 804 by a plurality of linear bearings (not shown) which allow upper rail 802 to slide with respect to lower rail 804 in a telescoping movement as the pullout is extended or retracted. Upper rail 802 is secured to the underside of the top shelf, in a horizontal orientation, that is, with the top rail above the lower rail, by screws (not shown) through holes 806, 808, 810 and 812. The horizontal orientation of the upper rail is important because it increases stability of the pullout, relative to the cabinet carcass when the pullout is in the extended position.

Lower rail 804 is adjustably attached to front bracket 820 by retainer bracket 818. Front bracket 820 includes horizontal flange 842 and upward vertical flange 836. The horizontal flange and vertical flange are substantially perpendicular. Horizontal flange 842 includes horizontal slot 838. Vertical flange 836 includes vertical slot 840.

Retainer bracket 818 includes flange 850 and flange 852 which are located on either side of web 854. Flange 850 includes threaded hole 828 and retainer tab 856. Retainer tab 856 extends from flange 850 substantially parallel over web 854. Flange 852 includes right angle slot 834. Web 854 includes threaded hole 832.

Figure 8A:
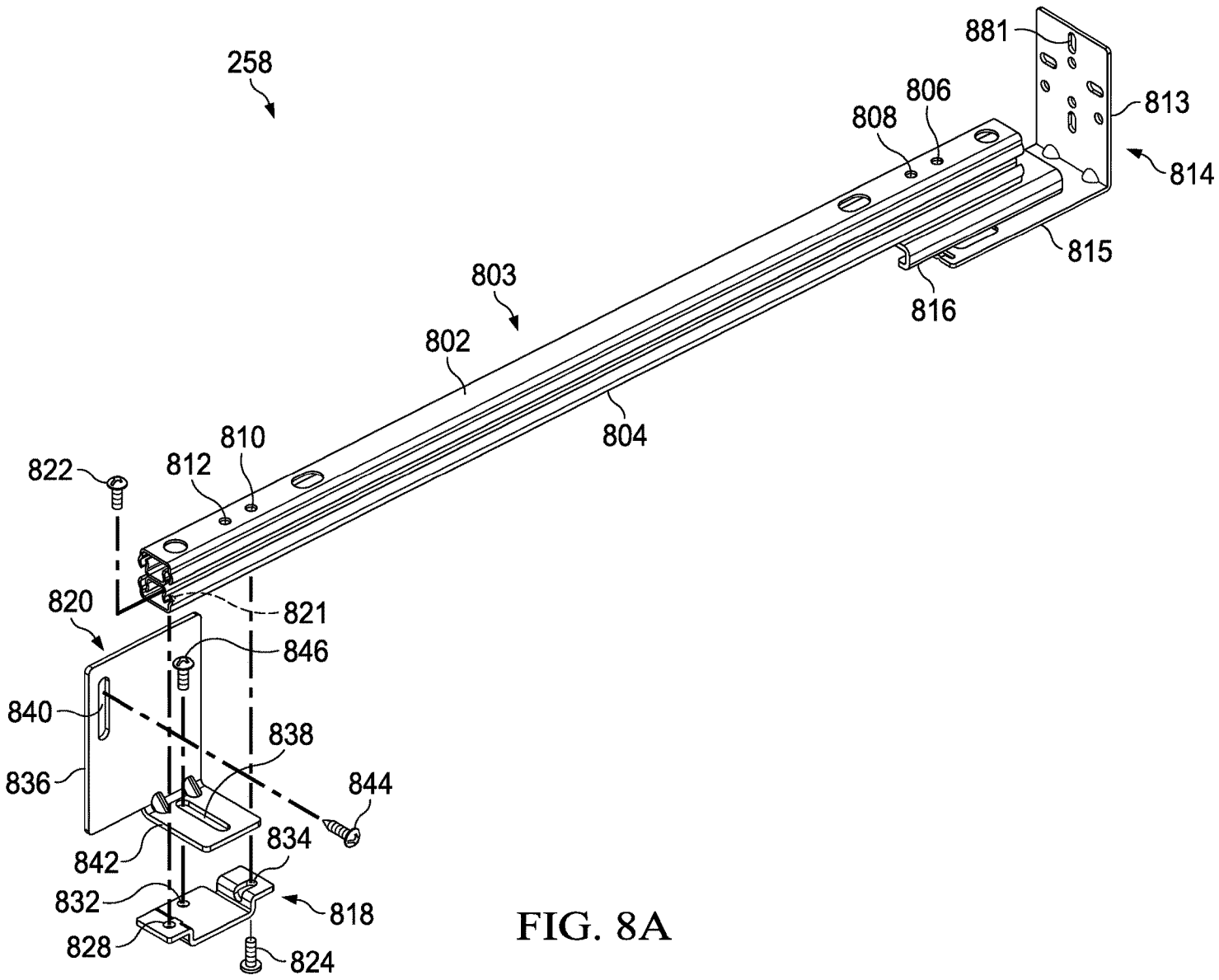
FIG. 8A is an exploded isometric view of a top slide subassembly of a preferred embodiment.
Figure 8B:
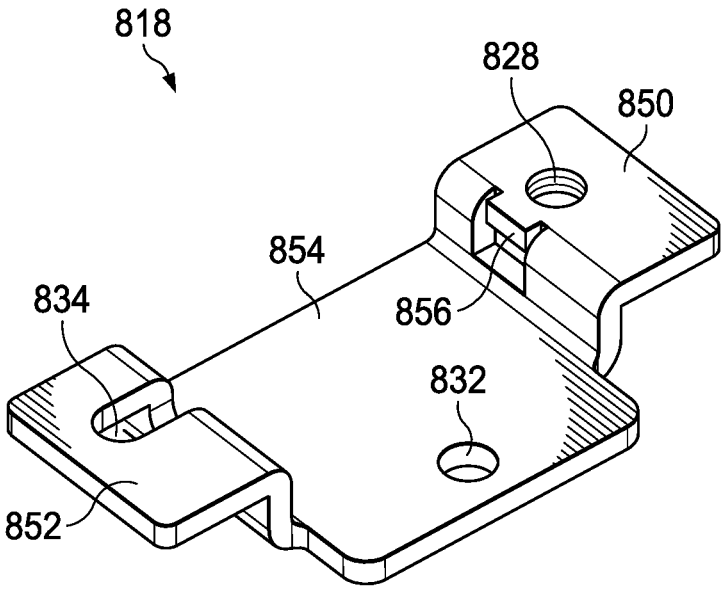
FIG. 8B is an isometric view of a bracket of a preferred embodiment.
Figure 8C:
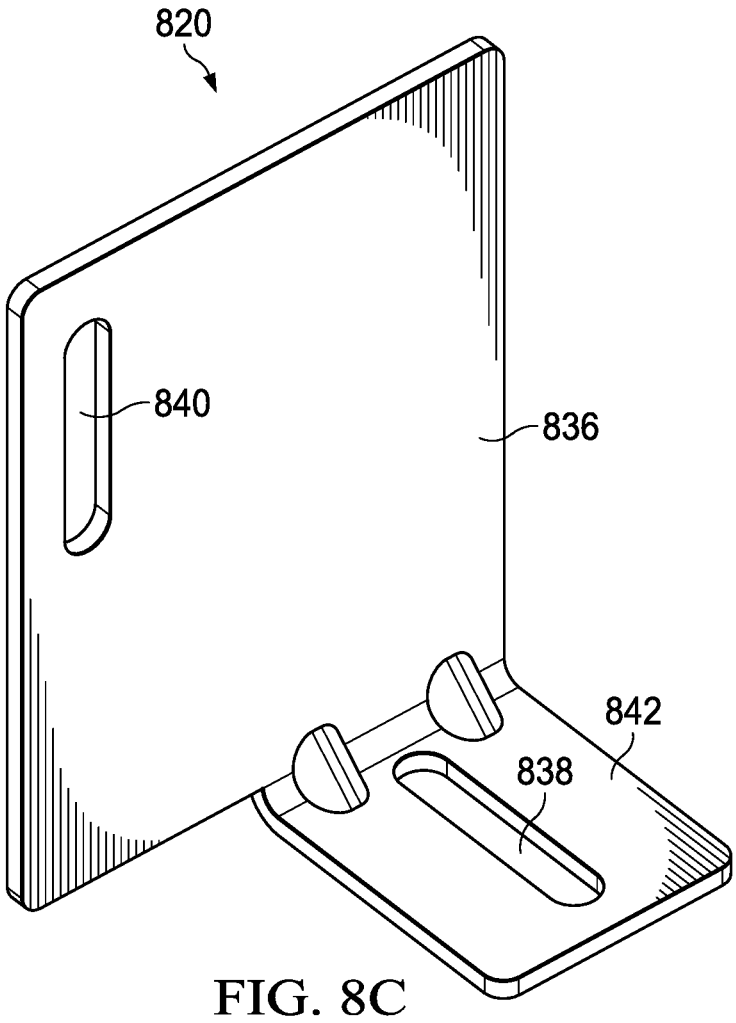
FIG. 8C is an isometric view of a side mount bracket of a preferred embodiment.
Figure 8D:
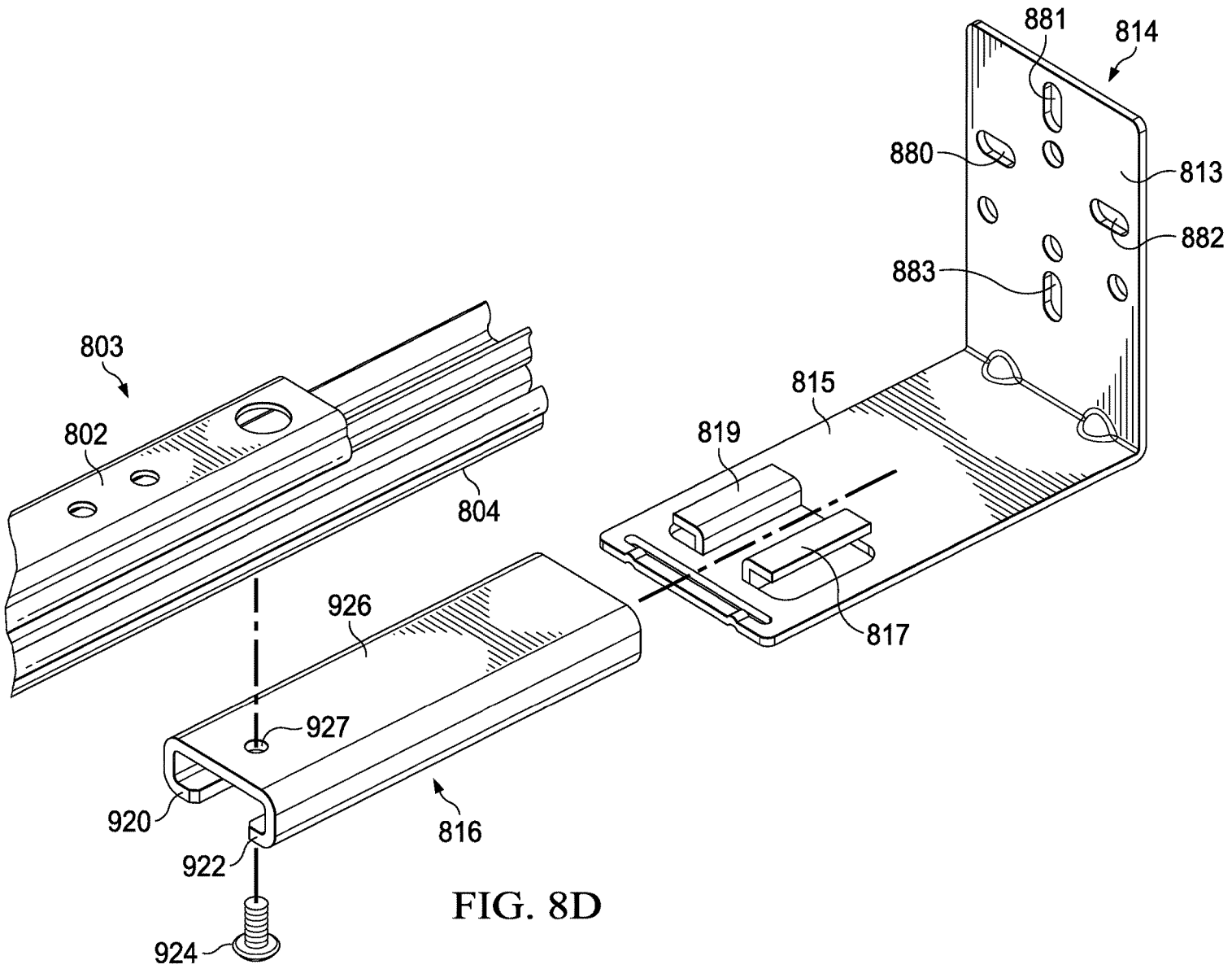
FIG. 8D is an exploded isometric view of a bracket and a top slide of a preferred embodiment.

Referring to FIG. 8D, lower rail 804 is also attached to rear bracket 814. Rear bracket 814 includes vertical flange 813 and horizontal flange 815. Vertical flange 813 is substantially perpendicular to horizontal flange 815. Vertical flange 813 includes holes 880, 881, 882 and 883, for attachment of rear bracket 814 to the cabinet carcass with screws (not shown). Holes 880 and 882 provide lateral adjustment of rear bracket 814. Holes 881 and 883 provide vertical adjustment of rear bracket 814. Horizontal flange 815 includes integral flanges 817 and 819. The integral flanges are parallel to the longitudinal axis of the horizontal flange and are diametrically opposed.

Slide connector 816 incorporates linear flanges 922 and 920. The linear flanges are integrally formed with web 926. Web 926 includes hole 927. Liner flange 922 is designed to slidingly engage integral flange 817. Linear flange 920 is designed to slidingly engage integral flange 819. Screw 924 is adapted to pass through hole 927 and into lower rail 804, thereby adjustingly securing it to the slide connector. In use, the slide connector is allowed to float on integral flanges 817 and 819 so as to allow depth adjustment of the lower rail with respect to the cabinet carcass.

In use, retainer bracket 818 is attached to the lower rail by screw 822 and screw 824. Screw 822 is inserted in hole 821 on the lower rail and threaded into threaded hole 828. Screw 824 is inserted through right angle slot 834 and into a threaded hole on the lower slide (not shown). Horizontal flange 842 is adjustably fitted between flange 850 and flange 852 and between web 854 and retainer tab 856. Screw 846 is inserted through slot 838 and threaded in threaded hole 832. Front bracket 820 can move laterally within the retainer bracket to adjust the horizontal distance between top drawer slide 803 and the cabinet carcass. Screw 844 is inserted through slot 840 and attached to the cabinet carcass thereby securing upward vertical flange 836 to the cabinet carcass. Slot 840 allows vertical adjustment of the lower rail. Screw 846 is tightened to secure the position of the lower rail with respect to the cabinet carcass.

Figure 9:
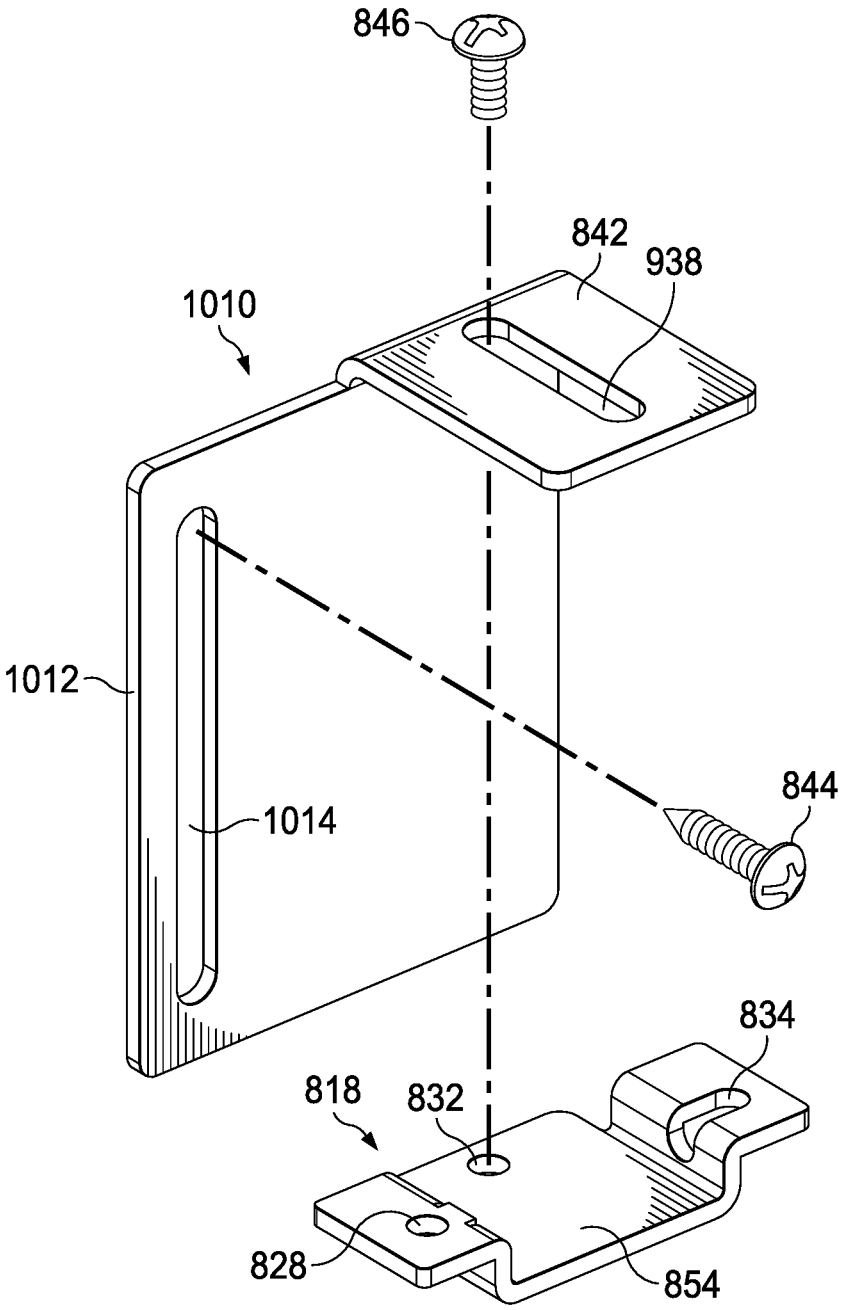
FIG. 9 is a partial exploded isometric view of a top slide bracket assembly of a preferred embodiment.

Referring to FIG. 9, an alternate embodiment of front bracket 820 will be described. Front bracket 1010 includes horizontal flange 842 and downward vertical flange 1012. Downward vertical flange 1012 extends downward substantially perpendicularly to horizontal flange 842. Horizontal flange 842 includes horizontal slot 938. Downward vertical flange 1012 includes vertical slot 1014. Screw 844, through slot 1014, adjustably secures front bracket 1010 to the cabinet carcass and provides vertical adjustment for the top rail relative to the cabinet carcass. Screw 846, through slot 938, adjustably secures front bracket 1010 to retainer bracket 818 and provides lateral adjustment for the top rail relative to the cabinet carcass. Lower rail 804 is secured to retainer bracket 818, as previously described.

Figure 10A:
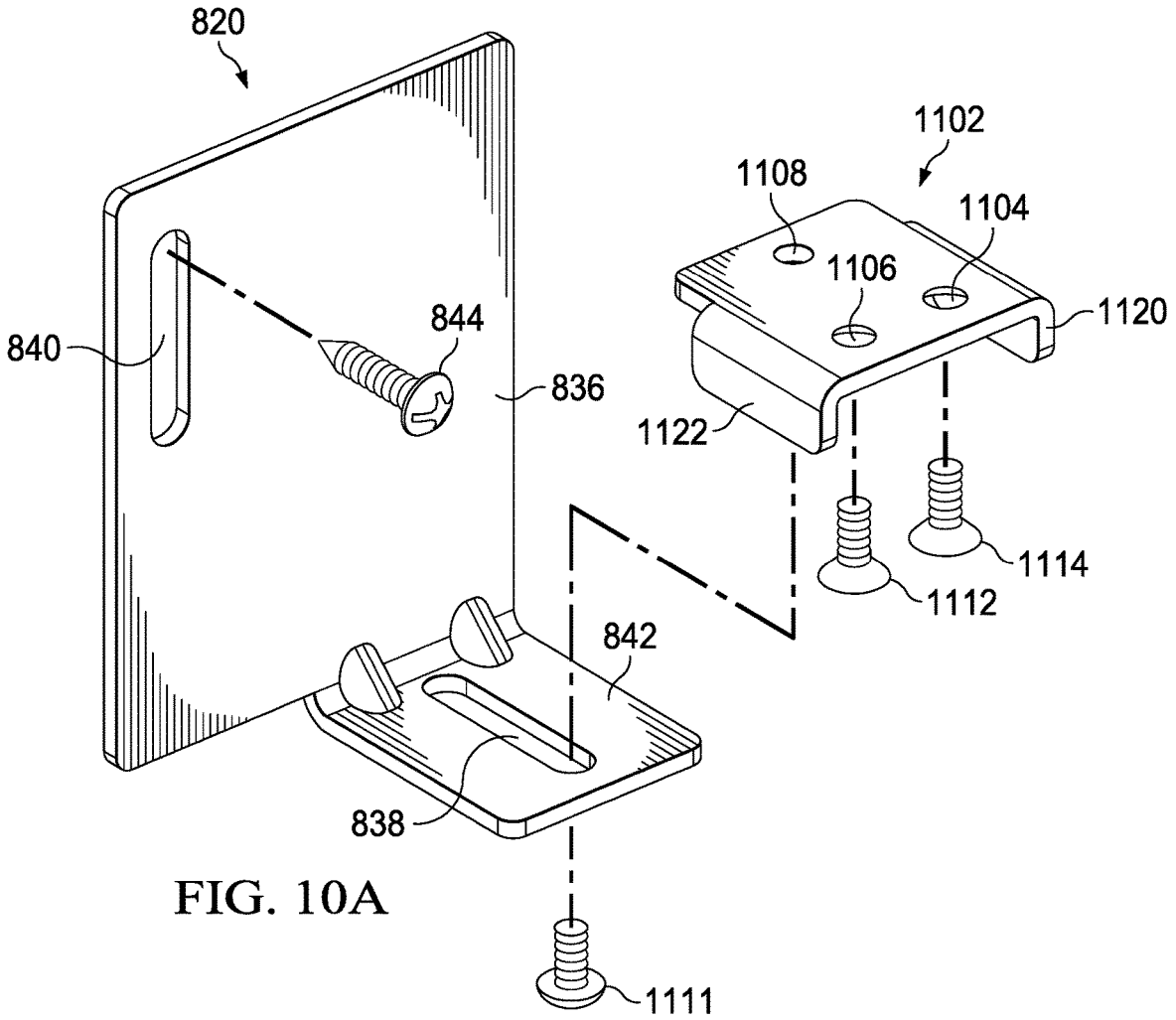
FIG. 10A is a partial exploded isometric view of a top slide bracket assembly of a preferred embodiment.
Figure 10B:
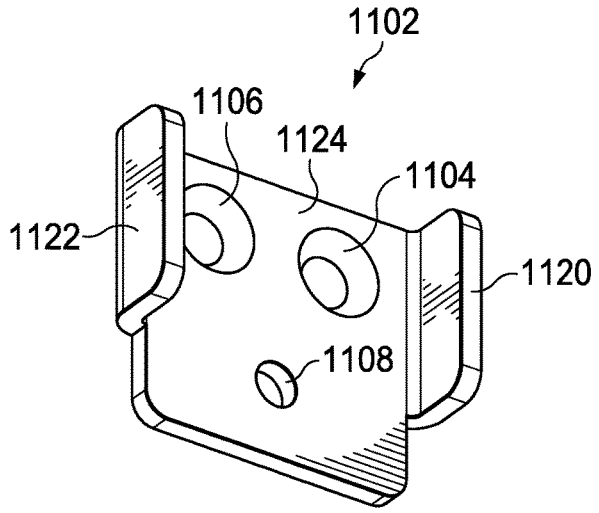
FIG. 10B is an isometric view of a retainer bracket of a preferred embodiment.

Referring to FIGS. 10A and 10B, an alternate embodiment of retainer bracket 818 will be described. Retainer bracket 1102 includes web 1124. Web 1124 includes hole countersink 1106, hole countersink 1104, and threaded hole 1108. Flanges 1120 and 1122 extend downward and substantially perpendicularly from web 1124.

Horizontal flange 842 fits between flanges 1120 and 1122. Flanges 1120 and 1122 act as a guide for horizontal adjustment of the top rail provided by horizontal flange 842. Screw 1111 is inserted through slot 838 and attached to threaded hole 1108. Screw 1111 is tightened to secure the horizontal position of horizontal flange 842. Screw 844 is tightened to secure the vertical position of front bracket 820.

In use, retainer bracket 1102 is attached to the bottom of the lower rail by countersink screws 1112 and 1114. The low clearance height provided by the countersink screws is important to allow the horizontal flange to slide within the flanges to laterally adjust the lower rail.

Figure 11:
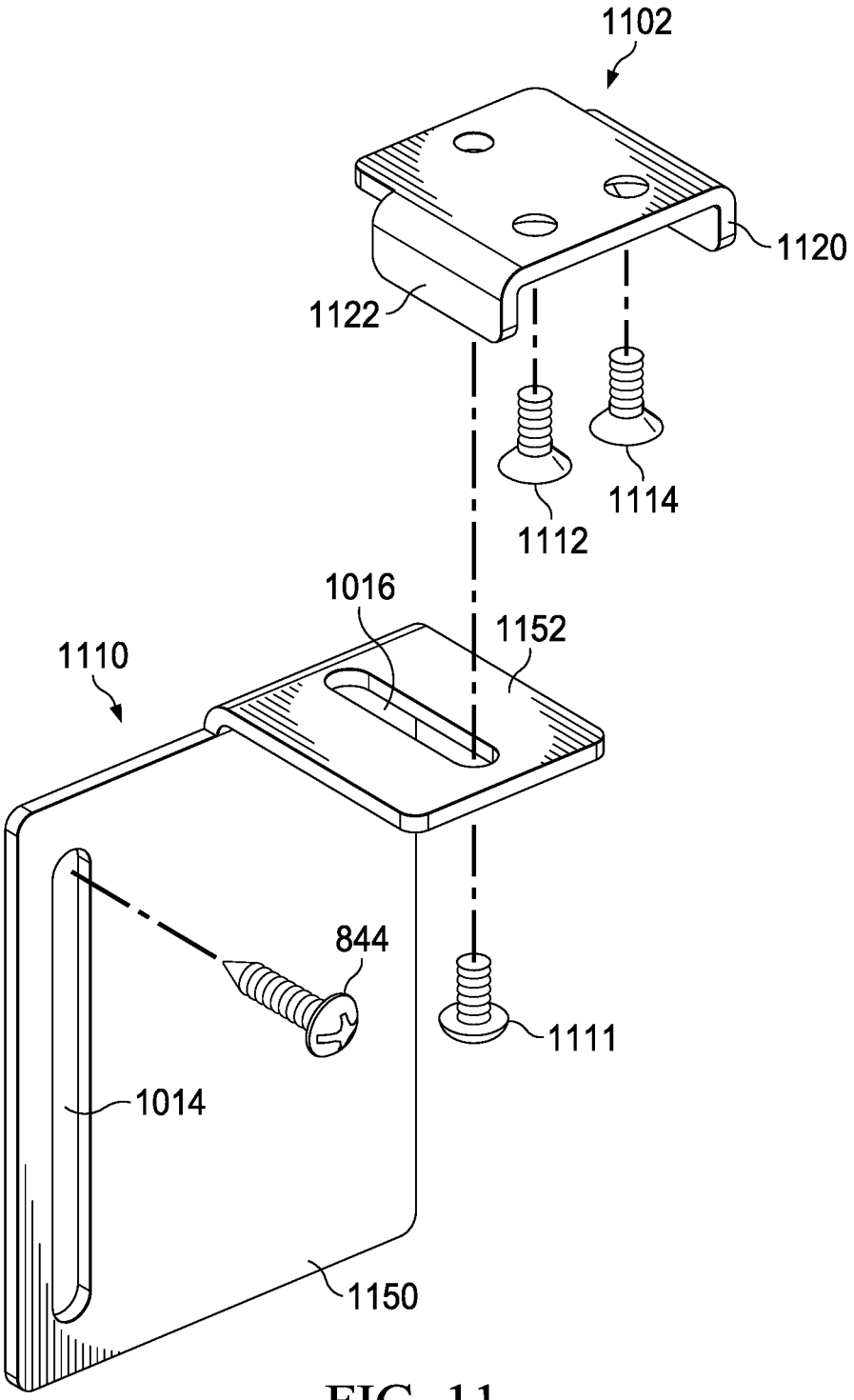
FIG. 11 is an exploded isometric view of a top slide bracket assembly of a preferred embodiment.

Referring to FIG. 11, an alternate embodiment of front bracket 820 will be described. Front bracket 1110 includes downward vertical flange 1150 integrally formed with horizontal flange 1152. Downward vertical flange 1150 includes vertical slot 1014. Horizontal flange 1152 includes horizontal slot 1016. Front bracket 1110 is positioned in retainer bracket 1102 guided by flanges 1120 and 1122. Screw 1111 is tightened to secure the horizontal position of the top slide with respect to front bracket 1110. Screw 844 is inserted through vertical slot 1014 into the cabinet carcass and secured to adjust the vertical position of the top slide relative to front bracket 1110.

Figure 12A:
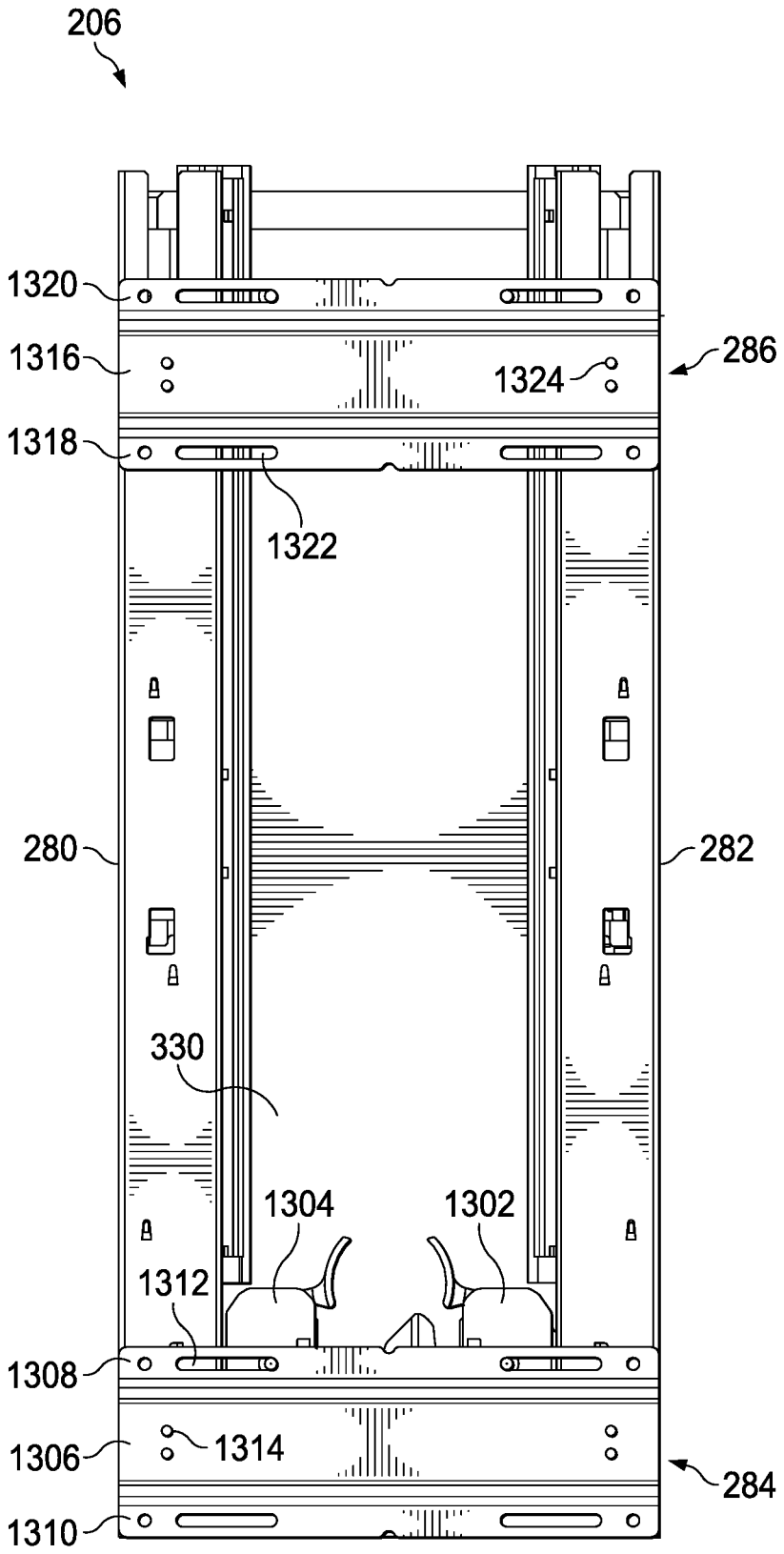
FIG. 12A is a bottom view of a kitchen pullout of a preferred embodiment.
Figure 12B:
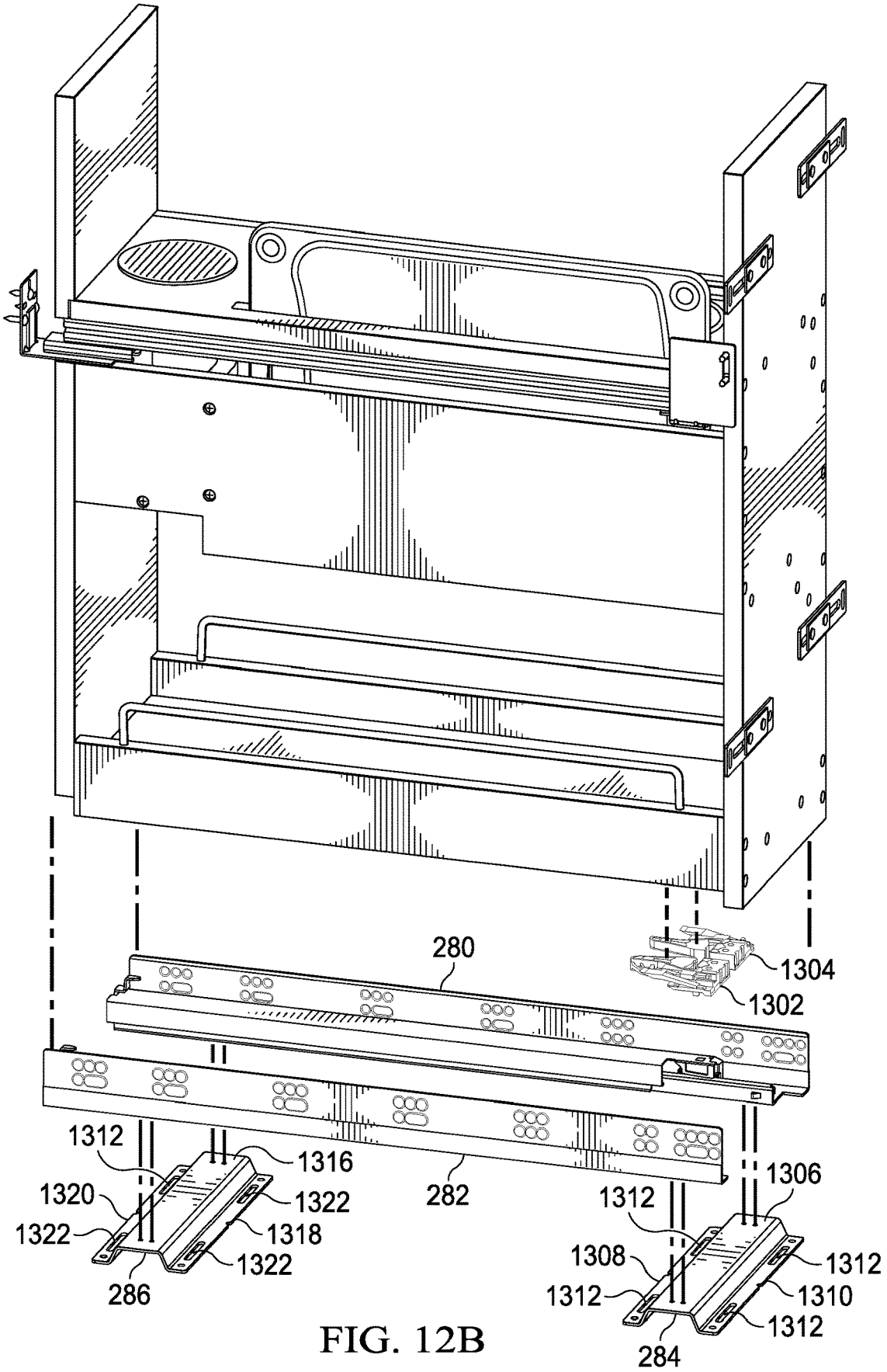
FIG. 12B is an exploded view of a kitchen pullout of a preferred embodiment.

Referring to FIGS. 12A and 12B, bottom slide subassembly 206 will be further described. Bottom slide subassembly 206 includes parallel telescoping horizontally oriented undermount drawer slides 280 and 282. Drawer slides 280 and 282 are removably and adjustably connected to bottom shelf 330 by undermount slide connectors 1302 and 1304. Details of the undermount slide connectors are disclosed in U.S. Pat. No. 9,782,001 to McGregor, which is incorporated herein by reference in its entirety.

The bottom slide subassembly further includes front base bracket 284 and rear base bracket 286. The front base bracket includes web 1306. Flanges 1308 and 1310 are integrally formed with web 1306. Flange 1308 includes a plurality of lateral slots 1312. Rivets 1314 connect the front base bracket generally perpendicularly to the slides. The rear base bracket includes web 1316. Flanges 1318 and 1320 are integrally formed with web 1316. Flange 1318 includes plurality of lateral slots 1322. Rivets 1324 connect the rear base bracket generally perpendicularly to the slides.

In use, the front base bracket and the rear base bracket, including drawer slides 280 and 282, are attached to the floor of the cabinet carcass by screws inserted through plurality of slots 1312 and 1322 in the base brackets The slots provide a horizontal adjustment for the pullout relative to the cabinet carcass. Vertical, lateral and depth adjustments are provided by the undermount slide connections.

Figure 13A:
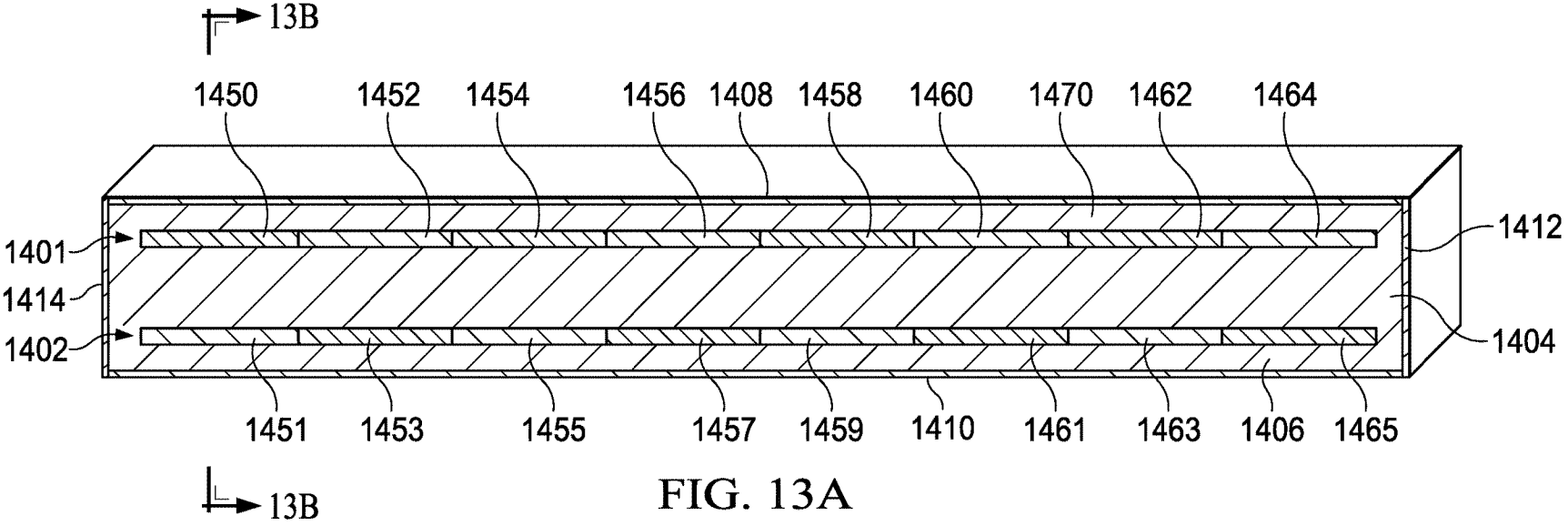
FIG. 13A is a cross-sectional view of a magnetic bar of a preferred embodiment.
Figure 13B:
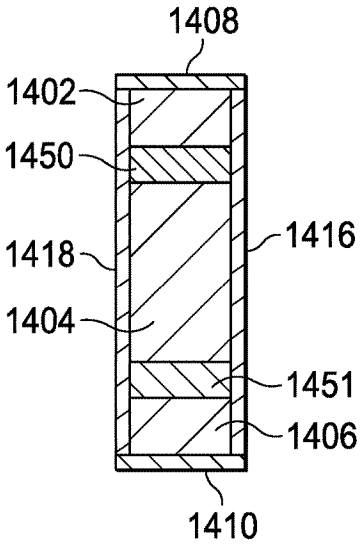
FIG. 13B is a cross-sectional view of a magnetic bar of a preferred embodiment.

Referring to FIGS. 13A and 13B, a preferred embodiment of the magnetic bar will be further described.

The magnetic bar is a sealed composite laminate comprised of top laminate 1408, top bar section 1470, magnet row 1401, mid-bar section 1404, magnet row 1402, bottom bar section 1406 and bottom laminate 1410. The magnetic bar is bounded at either end by laminate 1414 and by laminate 1412. The magnetic bar is bounded at either side by side laminate 1418 and 1416, respectively. Each layer of the composite laminate bar is bonded by a suitable industrial adhesive, preferably a water proof epoxy resin.

Magnet row 1401 is comprised of discrete rectangular magnets 1450, 1452, 1454, 1456, 1458, 1460, 1462 and 1464. Magnet row 1402 is comprised of discrete rectangular magnets 1451, 1453, 1455, 1457, 1459, 1461, 1463 and 1465. The magnets are arranged in an alternating polarity array that biases the resulting magnetic field toward the outward facing surfaces of the magnetic bar, as will be further described.

The laminates and sections in a preferred embodiment, are made of finished hardwood. In an alternate embodiment, top bar section 1470, mid-bar section 1404 and bottom bar section 1406 are made of marine plywood, Delrin® or Teflon®. In an alternate embodiment, top laminate 1408, bottom laminate 1410, side laminate 1418 and side laminate 1416 are made of Delrin® or Teflon® sheeting.

Figure 14:
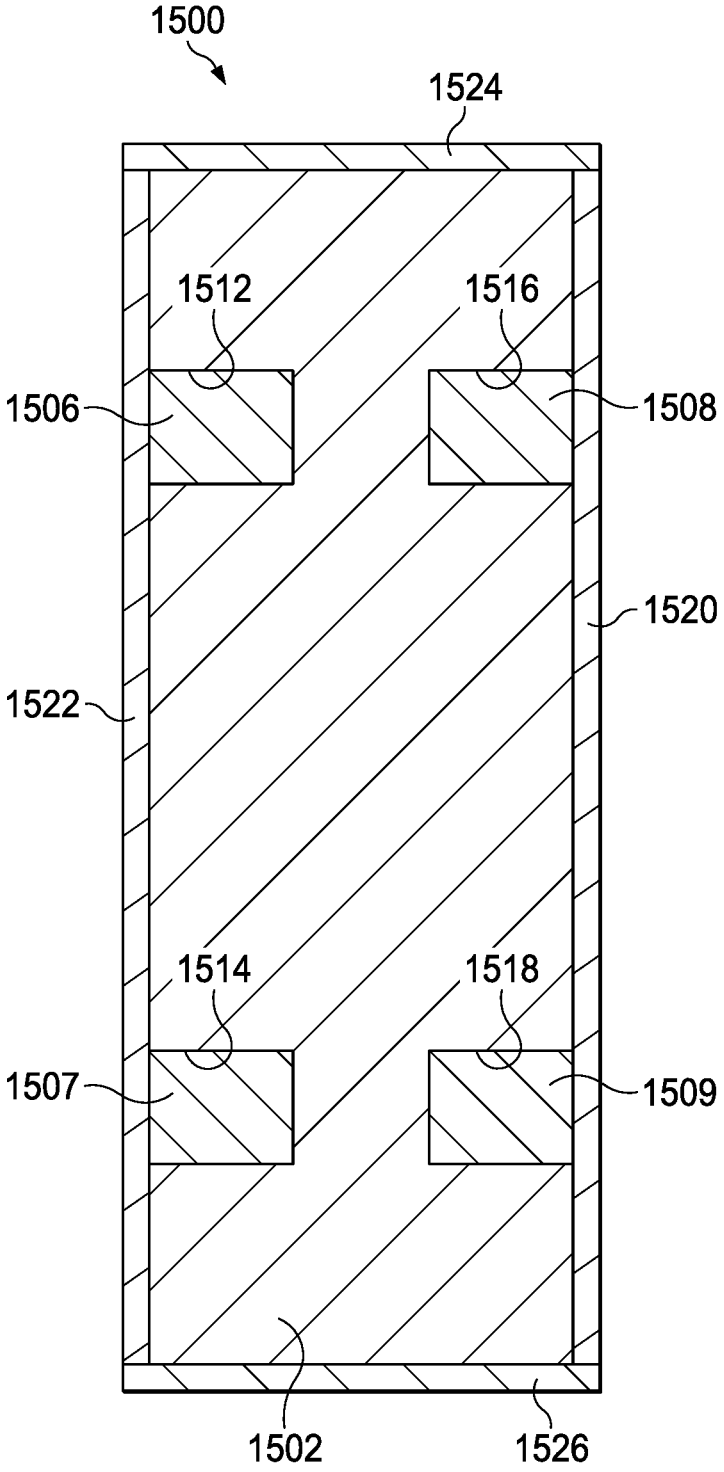
FIG. 14 is a cross-sectional view of a magnetic bar of a preferred embodiment.

Referring to FIG. 14, an alternate embodiment of magnetic bar 1500, will be described. Magnetic bar 1500 includes integrated core 1502. Integrated core 1502 further comprises longitudinal channels 1512, 1514, 1516 and 1518. Longitudinal channels 1512, 1514, 1516 and 1518 are generally parallel. Magnet row 1506 is positioned in longitudinal channel 1512. Magnet row 1507 is positioned in longitudinal channel 1514. Magnet row 1508 is positioned in longitudinal channel 1516. Magnet row 1509 is positioned in longitudinal channel 1518. The magnets in each magnet row alternate in polarity orientation, as will be further described. The sides of the beam are covered by side laminates 1520 and 1522. The top and the bottom of the beam are covered by top laminate 1524 and bottom laminate 1526, respectively.

Figure 15A:
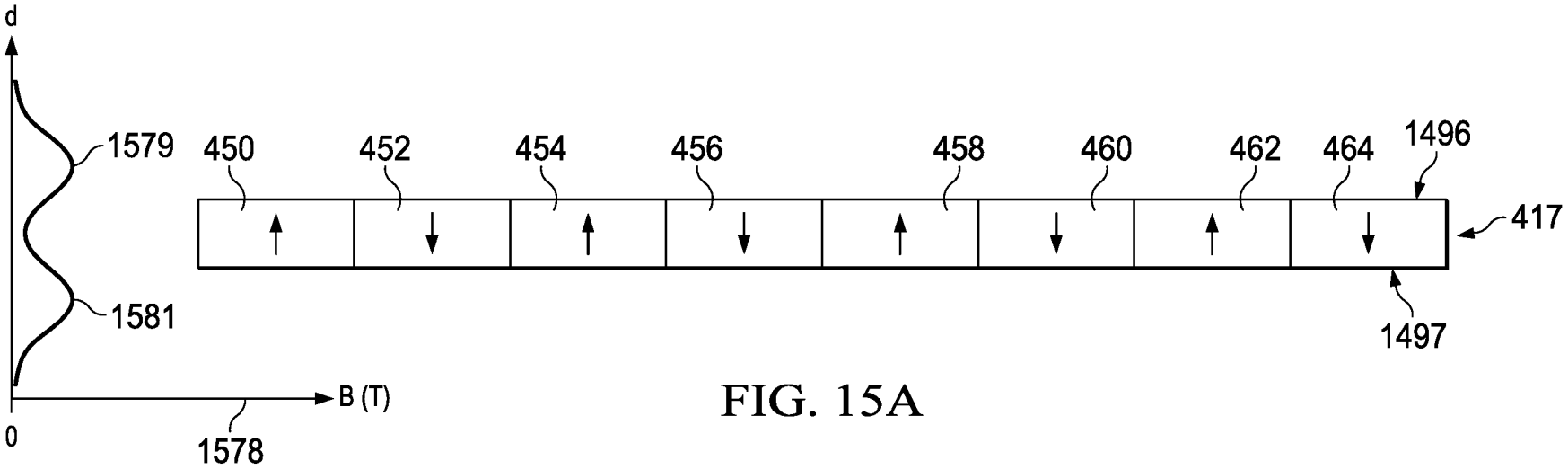
FIG. 15A is a schematic top view of a magnet row of a preferred embodiment.

Referring to FIG. 15A, a top view of magnet row 417 will be further described. Magnet row 417 comprises an array of magnets with alternating polarity. Magnets 450, 454, 458 and 462 are positioned so that their north poles are left facing, with respect to front panel 208. Magnets 452, 456, 460 and 464 are positioned so that their north poles are right facing with respect to front panel 208.

Graph 1578 shows the relative magnetic field density, in Tesla, with respect to distance across the magnet row. The graph shows local maxima 1579 and 1581, adjacent left magnet row face 1496 and right magnet row face 1497, respectively.

Figure 15B:
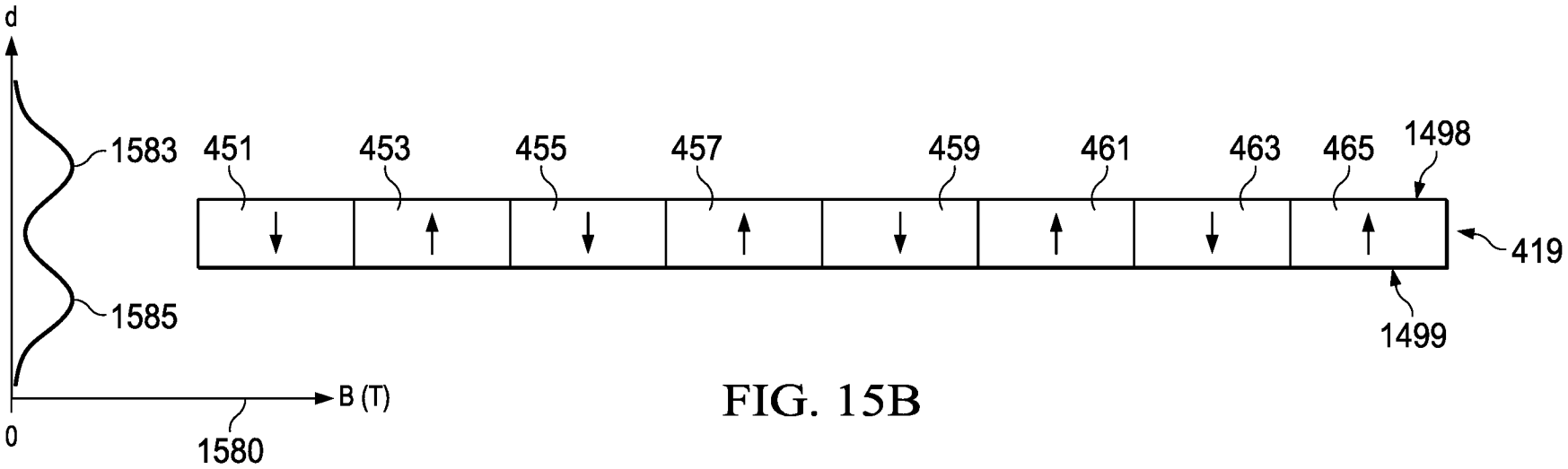
FIG. 15B is a schematic top view of a magnet row of a preferred embodiment.

Referring to FIG. 15B, a top view of magnet row 419 will be further described. Magnet row 419 comprises an array of magnets with alternating polarity which is opposite to the alternating polarity of magnet row 417. Magnets 451, 455, 459 and 463 are positioned so that their north poles are right facing, with respect to front panel 208. Magnets 453, 457, 461 and 465 are positioned so that their north poles are left facing with respect to front panel 208.

Graph 1580 shows a relative magnetic field density, in Tesla, with respect distance across the magnet row. The graph shows a local maxima 1583 and 1585 adjacent left magnet row face 1498 and right magnet row face 1499, respectively.

The maxima indicated in the graphs shows that the arrays increases the magnetic field density immediately left and immediately right of the magnetic bar. The varying strength of the magnetic field relative to the magnet rows is important because it increases the attraction of the magnetic bar to metallic knives, thereby greatly stabilizing the knives when the pullout mechanism is deployed, while at the same time decreasing the likelihood of magnetization of the metallic knives during prolonged storage periods.

Figure 15C:
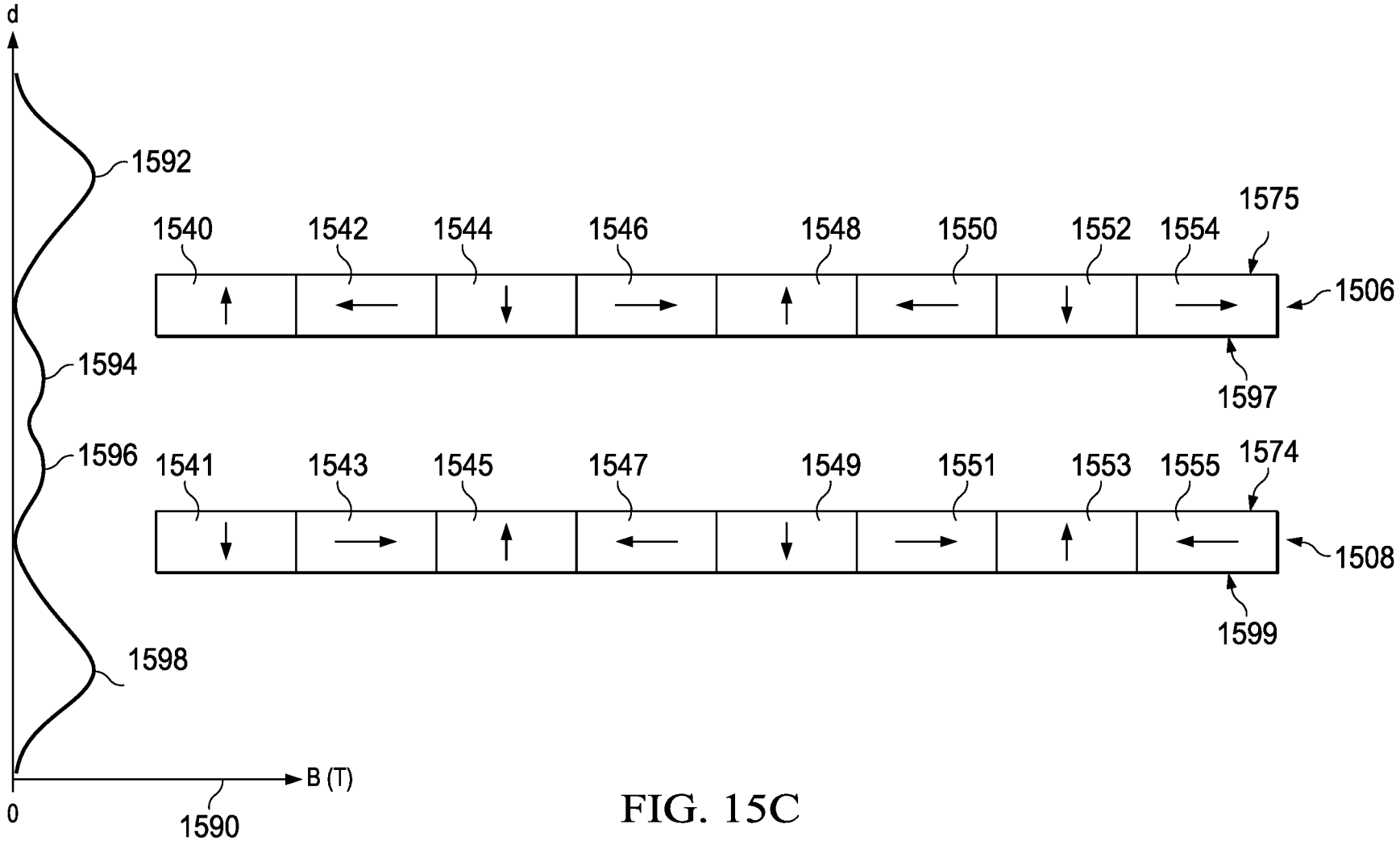
FIG. 15C is a paired set of magnet rows of a preferred embodiment.

Referring to FIG. 15C, a top view of magnet rows 1506 and 1508 will be further described. The magnets in each of magnet rows 1506 and 1508 form separate outwardly biased Halbach arrays.

As to magnet row 1506, magnets 1540 and 1548 are positioned with their north poles right facing with respect to front panel 208. Magnets 1542 and 1550 are positioned with their north poles facing back to front. Magnets 1544 and 1552 are positioned with their north poles left facing with respect to front panel 208. Magnets 1546 and 1554 are positioned with their north poles facing front to back.

As to magnet row 1508, magnets 1541 and 1549 are positioned with their north poles right facing with respect to panel 208. Magnets 1543 and 1551 are positioned with their north poles facing front to back. Magnets 1545 and 1553 are positioned with their north poles right facing with respect to front panel 208. Magnets 1547 and 1555 are positioned with their north poles facing back to front.

Referring to graph 1590, a graph of magnetic field density, B, in Tesla, versus distance across the magnetic bar is described. The graph indicates a local maxima 1592, adjacent left magnet row face 1575. Graph 1590 further indicates a maxima 1598 adjacent right magnet face 1599. Graph 1590 further indicates a reduced maxima 1594 adjacent right magnet row face 1597. Graph 1590 further indicates a reduced maxima 1596 adjacent left magnet row face 1574. Graph 1590 further indicates that maxima 1592 and maxima 1598 are approximately three times the size of reduced maxima 1594 and 1596, thereby indicating that the magnetic field density is much higher to the left of magnet row 1506 and to the right of magnet row 1508, than it is between them. This result is important because the greatly increased magnetic field to the left and to the right of the magnetic bar maximizes the attraction of the magnetic bar to the metallic knives, while simultaneously greatly reducing the likelihood of magnetization of the knives due to prolonged proximity with the magnetic bars.

Figure 16:
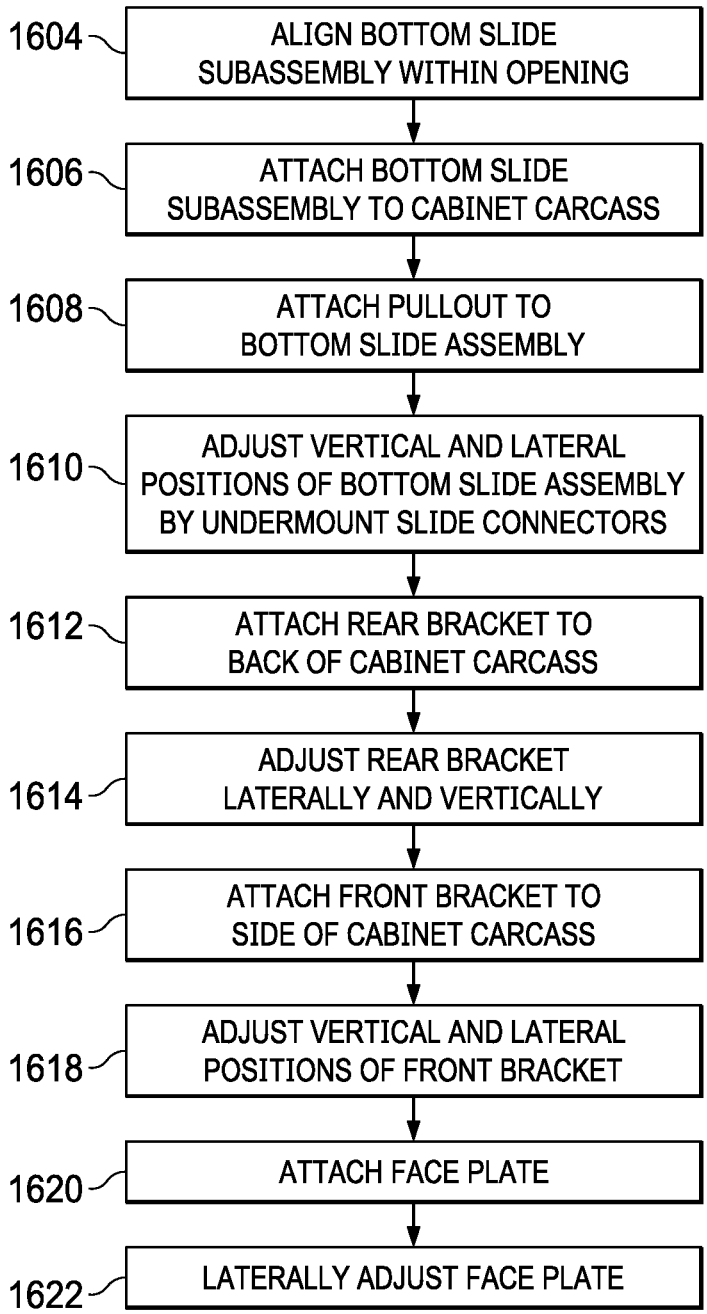
FIG. 16 is a flowchart of a preferred embodiment of a method of installation.

Referring to FIG. 16, at step 1604, the bottom slide subassembly is aligned within the cabinet carcass such that it is centered in the cabinet opening.

At step 1606, the bottom slide subassembly is attached to the bottom of the cabinet carcass by screws inserted through the plurality of slots 1312 and 1322.

At step 1608, the bottom shelf is attached to the bottom slide subassembly. The undermount drawer slides of the bottom subassembly engage the slide connectors attached to the bottom shelf.

At step 1610, the vertical and lateral position of the bottom slide subassembly is adjusted for vertical depth and lateral placement with the undermount slide connectors as disclosed in U.S. Pat. No. 9,782,001 to McGregor, incorporated herein by reference.

At step 1612, the rear bracket is attached to the back wall of the cabinet carcass.

At step 1614, the rear bracket is then adjusted vertically and laterally before tightening the screws in the holes to fix the position of the rear bracket with respect to the cabinet carcass.

At step 1616, the front bracket is attached to the cabinet carcass.

At step 1618, the front bracket is then adjusted vertically and laterally before tightening the screws in the holes to fix the position of the top slide with respect to the cabinet carcass.

At step 1620, the face plate is attached to the face plate mount brackets, to conceal the pullout mechanism.

At step 1622, the face plate is adjusted laterally as described in U.S. Pat. No. 10,251,480 to Chen.

Figure 17A:
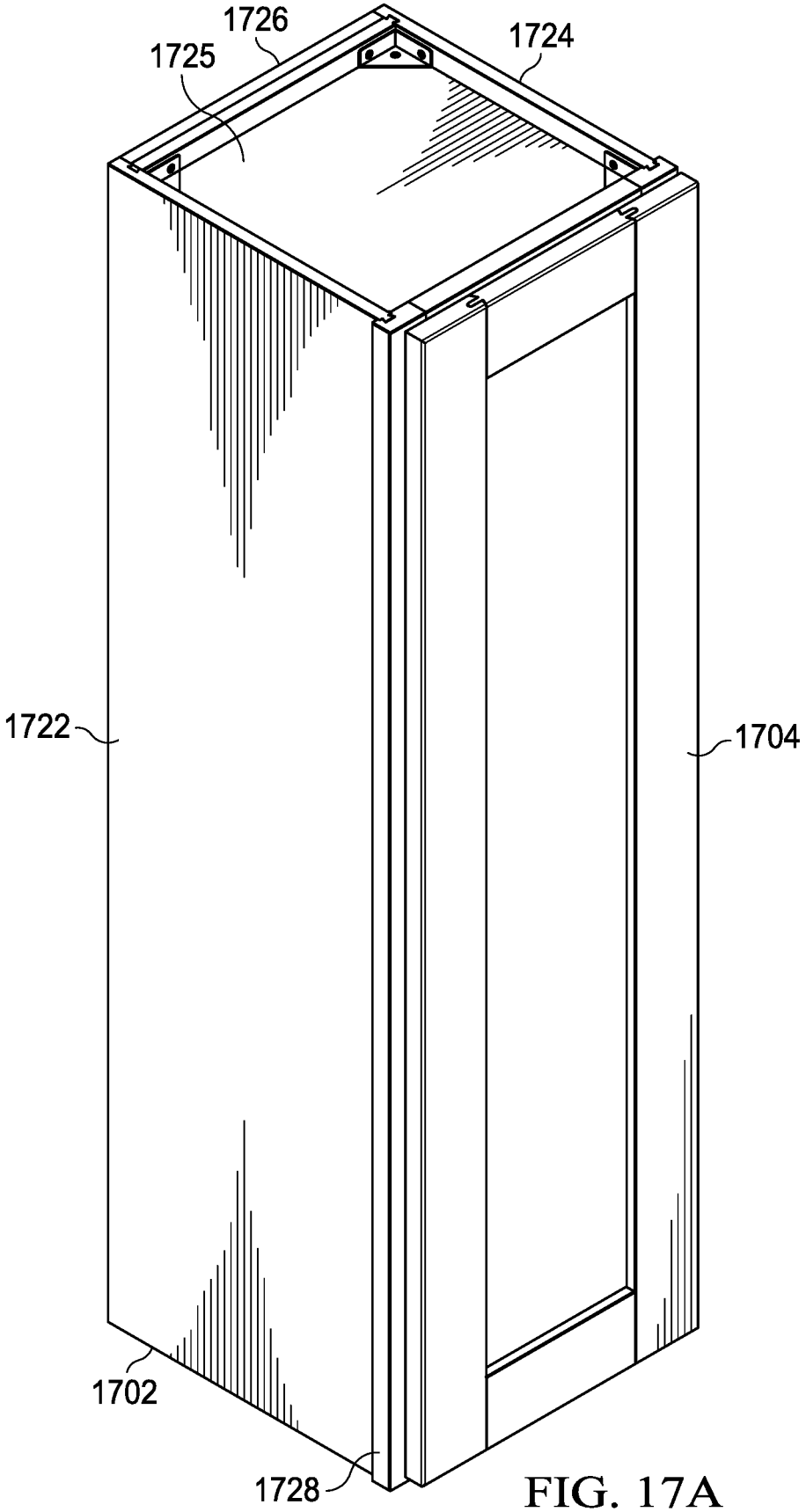
FIG. 17A is an isometric view of a cabinet pullout of a preferred embodiment in a stowed position.

Referring to FIG. 17A, cabinet pullout 1704 is shown in a stowed position, concealed within cabinet carcass 1702. Cabinet carcass 1702 includes side wall 1722, back wall 1726, side wall 1724, carcass top 1725, face frame 1728, and a carcass floor, as will be further described. Side walls 1722 and 1724 are generally perpendicular to back wall 1726 and face frame 1728.

Figure 17B:
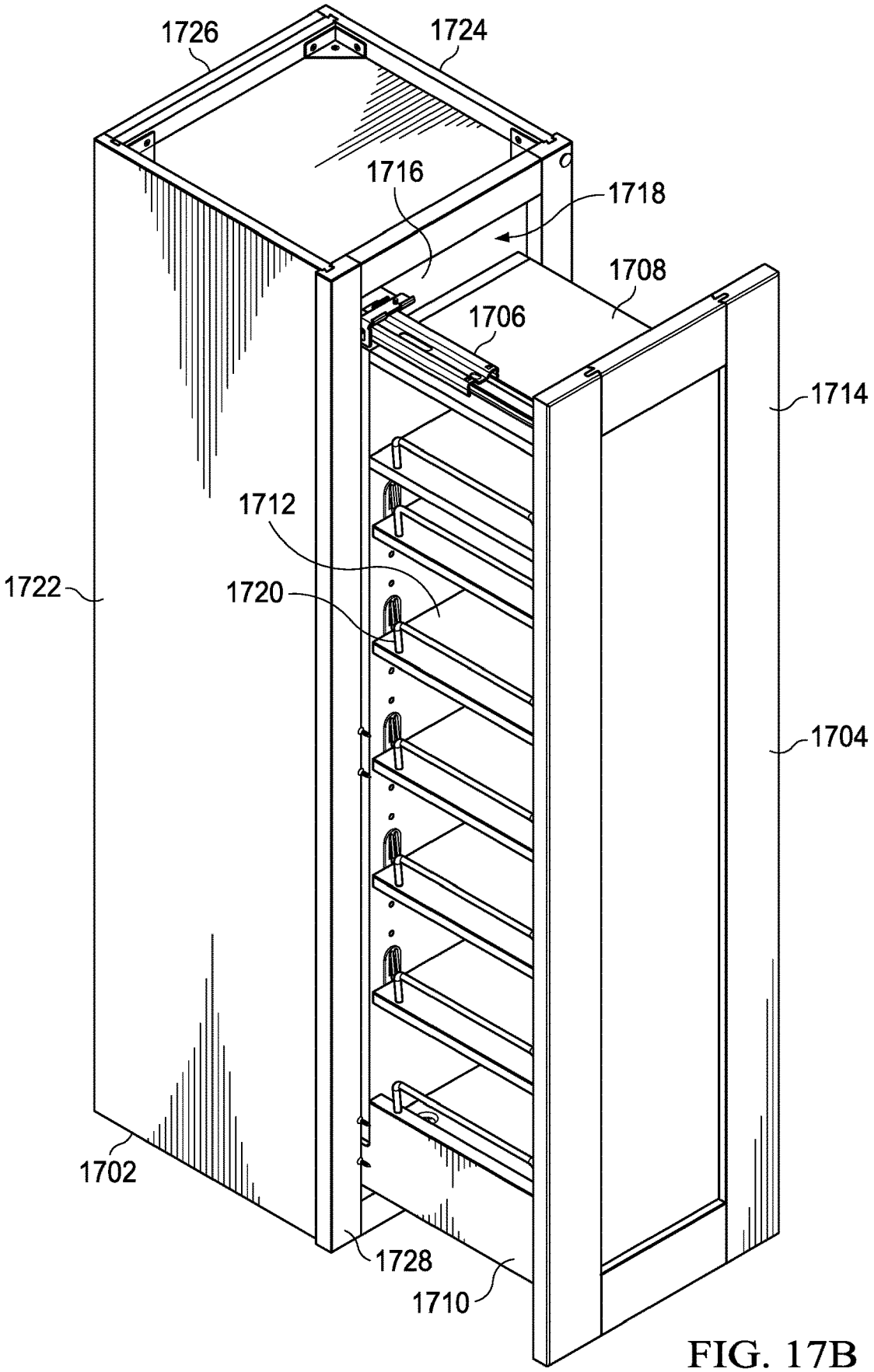
FIG. 17B is an isometric view of a cabinet pullout of a preferred embodiment in a deployed position.

Referring to FIG. 17B, cabinet pullout 1704 is shown in a deployed position. Cabinet pullout 1704 includes back panel 1716, pullout top 1708, concealment box 1710, and a front panel (not shown). Face plate 1714 is fixed to the front panel, as previously described. Pullout top 1708 and concealment box 1710 are attached to back panel 1716 and the front panel. Between pullout top 1708 and concealment box 1710 are generally parallel and adjustable shelves 1712. Shelves 1712 and concealment box 1710 include side rails 1720, as previously described. Top slide subassembly 1706 is attached to pullout top 1708 and cabinet carcass 1702, as will be further described. A bottom slide subassembly (not shown) is concealed within and attached to concealment box 1710, as will be further described. Cabinet pullout 1704 is horizontally centered within opening 1718 of face frame 1728.

Figure 18:
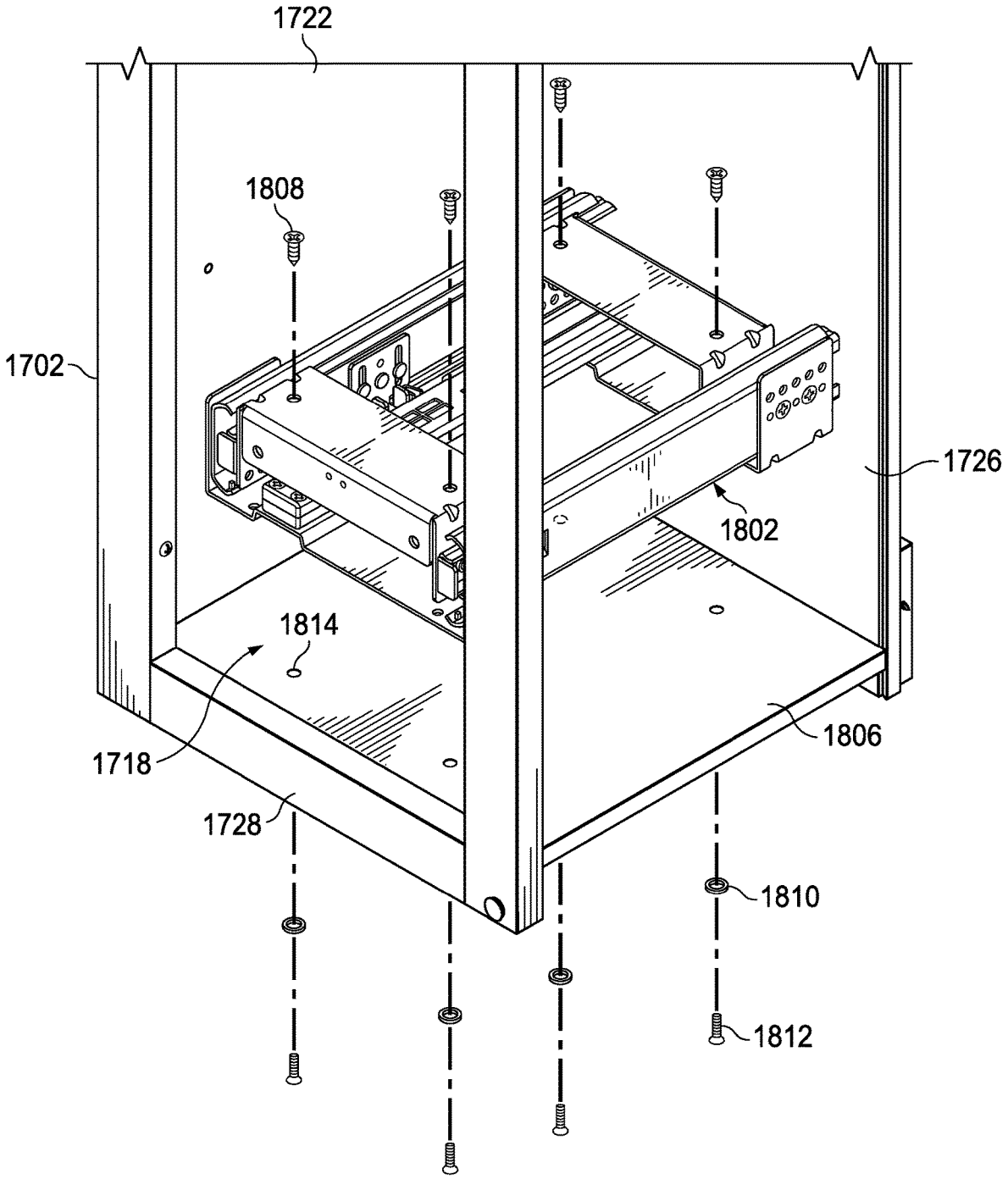
FIG. 18 is an exploded isometric view of a bottom slide subassembly in a cabinet carcass.

Referring to FIG. 18, bottom slide subassembly 1802 and cabinet carcass 1702 will be further described. Cabinet carcass 1702 further includes carcass floor 1806. Bottom slide subassembly 1802 can be attached either above or below carcass floor 1806. Bottom slide subassembly 1802 is attached to carcass floor 1806 with bolts 1812, as will be further described. Alternatively, bolts 1812 fit through washers 1810, through holes 1814, and into threaded holes in bottom slide subassembly 1802, as will be further described.

Figure 19A:
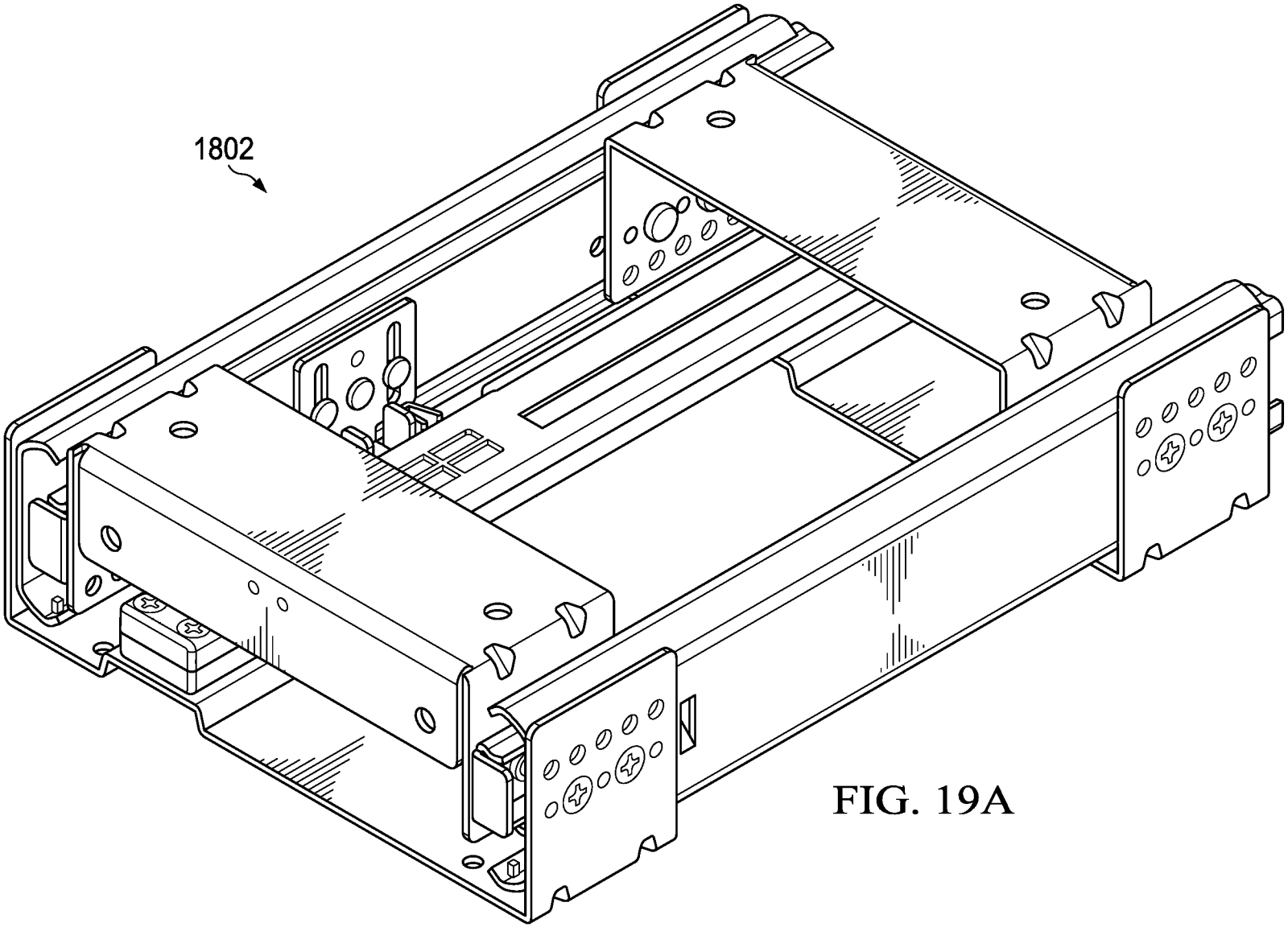
FIG. 19A is an isometric view of a bottom slide subassembly in a stowed position.

Referring to FIG. 19A, bottom slide subassembly 1802 is shown in a stowed position.

Figure 19B:
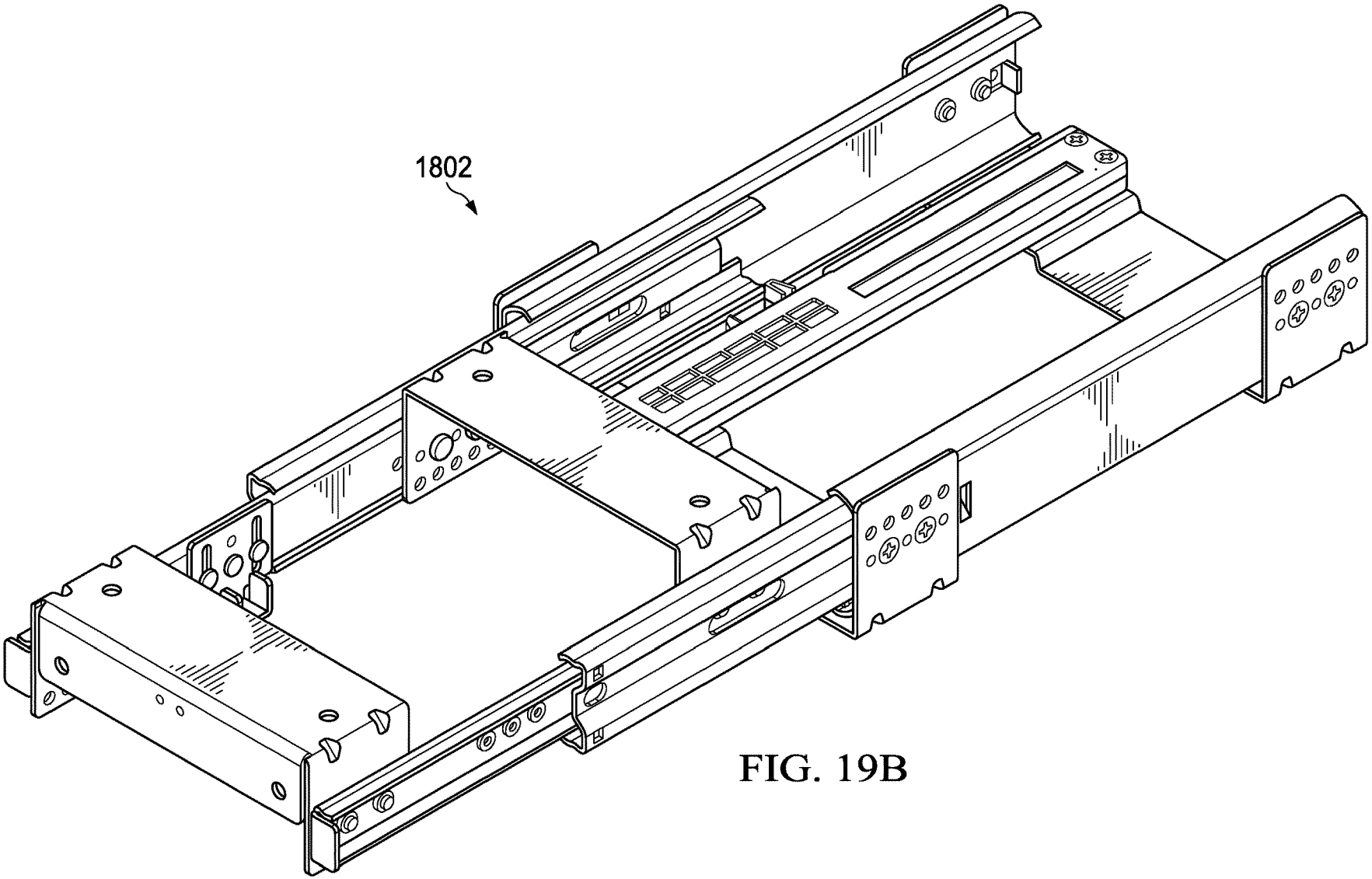
FIG. 19B is an isometric view of a bottom slide subassembly in a deployed position.

Referring to FIG. 19B, bottom slide subassembly 1802 is shown in a deployed position.

Figure 20:
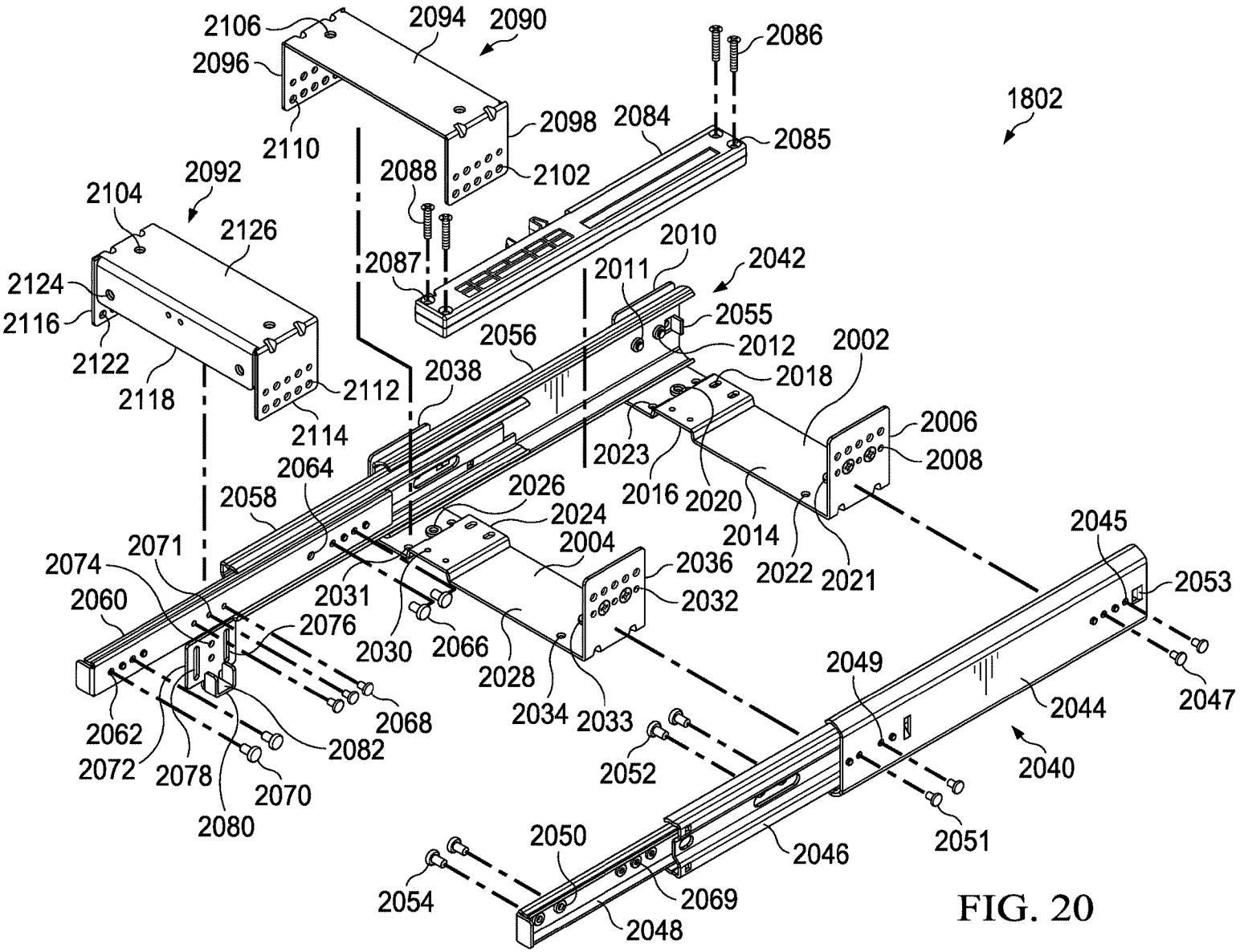
FIG. 20 is an exploded isometric view of a bottom slide subassembly.

Referring to FIG. 20, bottom slide subassembly 1802 includes rear base bracket 2002, front base bracket 2004, slide 2040, slide 2042, spring damper assembly 2084, rear support bracket 2090, and front support bracket 2092.

Rear base bracket 2002 includes flange 2006, flange 2010, and web 2014. Flanges 2006 and 2010 are substantially perpendicular to web 2014 and substantially parallel to each other. Flange 2006 includes holes 2008 to enable attachment to slide 2040. Flange 2010 has a similar arrangement of holes (not shown) to enable attachment to slide 2042. Web 2014 includes step 2016. Step 2016 is an integrally formed elevated portion of web 2014 positioned adjacent flange 2010 and includes threaded holes 2018. Web 2014 further includes threaded hole 2020 and through holes 2023 positioned between step 2016 and flange 2010. Web 2014 further includes threaded hole 2021 and through holes 2022 positioned between step 2016 and flange 2006.

Front base bracket 2004 includes flange 2036, flange 2038, and web 2028. Flanges 2036 and 2038 are substantially perpendicular to web 2028 and substantially parallel to each other. Flange 2036 includes holes 2032 to enable attachment to slide 2040. Flange 2038 has a similar arrangement of holes (not shown) to enable attachment to slide 2042. Web 2028 includes step 2024. Step 2024 is an integrally formed elevated portion of web 2028 positioned adjacent flange 2038 and includes threaded holes 2030. Web 2028 further includes threaded hole 2026 and through holes 2031 positioned between step 2024 and flange 2038. Web 2028 further includes threaded hole 2033 and through holes 2034 positioned between step 2024 and flange 2036.

Slide 2040 is vertically oriented in the bottom slide assembly so as to increase its weight bearing capacity. Slide 2040 includes outer rail 2044, intermediate rail 2046, and inner rail 2048. Outer rail 2044 is engaged with intermediate rail 2046 by a plurality of linear bearings (not shown) and intermediate rail 2046 is engaged with inner rail 2048 by a plurality of linear bearings (not shown) which allow outer rail 2044 to telescopically move with respect to intermediate rail 2046 and intermediate rail 2046 to telescopically move with respect to inner rail 2048 as the cabinet pullout is deployed and stowed. Inner rail 2048 further includes threaded holes 2050, threaded holes 2069, and further threaded holes (not shown) for receiving screws 2052. Outer rail 2044 includes threaded holes 2045 and threaded holes 2049. Outer rail 2044 further comprises stop flange 2053. In use, the stop flange constrains the travel path of intermediate rail 2058.

Slide 2042 is vertically oriented in the bottom slide subassembly so as to increase its weight bearing capacity. Slide 2042 includes outer rail 2056, intermediate rail 2058, inner rail 2060, and damper engagement bracket 2072. Outer rail 2056 is engaged with intermediate rail 2058 by a plurality of bearings (not shown) and intermediate rail 2058 is engaged with inner rail 2060 by a plurality of bearings (not shown) which allow outer rail 2056 to slide with respect to intermediate rail 2058 and intermediate rail 2058 to slide with respect to inner rail 2060 in a telescoping movement as the pullout is deployed and stowed. Inner rail 2060 further includes threaded holes 2062, threaded holes 2064, and threaded holes 2071. Outer rail 2056 includes threaded holes 2012 and threaded holes (not shown) to attach to flange 2038. Outer rail further comprises stop flange 2055 to constrain the motion of intermediate rail 2046.

Damper engagement bracket 2072 includes slot 2078, slot 2076, hole 2074, and stop flange 2080. Stop flange 2080 includes recess 2082. In the left-hand orientation of the bottom slide subassembly, damper engagement bracket 2072 is attached to inner rail 2060 by screws 2068 inserted through slots 2076 and 2078, and hole 2074 and into threaded holes 2071. In the right-hand orientation of the bottom slide subassembly, damper engagement bracket 2072 is attached to inner rail 2048 by screws 2068 inserted through slots 2076 and 2078 and hole 2074 into threaded holes 2069. In either case, recess 2082 is positioned below the path of travel of the slides.

Spring damper assembly 2084 includes holes 2087 and holes 2085, whose use will be further described.

In a preferred embodiment, the front base bracket and the rear base bracket are positioned in a left-hand orientation, where the steps and the stop flange are on the left-hand side of the bottom slide subassembly. In the left-hand orientation, the spring damper assembly is also positioned on the left-hand side. However, the base brackets and the stop flange may be positioned in a right-hand orientation where the steps, the stop flange and the spring damper assembly are on the right-hand side of the bottom slide subassembly. In this way the brackets are reversable, so as to accommodate various cabinet carcass arrangements installation requirements.

Rear support bracket 2090 includes web 2094, flange 2098, and flange 2096. Flanges 2098 and 2096 are substantially perpendicular to web 2094 and substantially parallel to each other. Flange 2096 includes holes 2110. Flange 2098 includes holes 2102. Web 2094 includes threaded holes 2106.

Front support bracket 2092 includes web 2126, flange 2114, flange 2116, and flange 2118. Flanges 2114, 2116, and 2118 extend substantially perpendicular to web 2126 and substantially parallel to each other. Flange 2114 includes holes 2112. Flange 2116 includes holes 2122. Flange 2118 extends generally perpendicularly and downwardly from web 2126, and generally perpendicularly to and between flange 2114 and flange 2116. Flange 2118 includes threaded holes 2124. Web 2126 includes threaded holes 2104.

In a preferred embodiment, holes 2102, 2110, 2112, and 2122 are arranged in a plurality of two rows of five holes each. The plurality of holes is designed to accommodate different sized drawers and different sized slides and further allows adjustability to the positioning of the support brackets on the pullout.

When the bottom slide subassembly is assembled in a left-hand orientation, slide 2040 is attached to flange 2006 by screws 2047 inserted through holes 2008 and into threaded holes 2045 and attached to flange 2036 by screws 2051 inserted through holes 2032 and into threaded holes 2049, respectively. Slide 2042 is attached to flange 2010 by screws 2011 inserted through holes in flange 2010 and into threaded holes 2012 and attached to flange 2038 by screws into threaded holes on outer rail 2056, respectively.

Rear support bracket 2090 is attached to inner rail 2060 and inner rail 2048. Screws 2066 are inserted through holes 2110 and into threaded holes 2064. Screws 2052 are inserted through holes 2102 and into threaded holes on inner rail 2048. Front support bracket 2092 is attached to inner rail 2060 and inner rail 2048. Screws 2070 are inserted through holes 2122 and into threaded holes 2062. Screws 2054 are inserted through holes 2112 and into threaded holes 2050. In the preferred embodiment, the height and position of front support bracket 2092 and rear support bracket 2090 with respect to inner rails 2048 and 2060 are adjustable based on which row and specific holes of holes 2102, 2110, 2112, and 2122 are used.

Spring damper assembly 2084 is attached to step 2016 by screws 2086 through holes 2085 and into threaded holes 2018 and to step 2024 by screws 2088 through holes 2087 and into threaded holes 2030.

When the bottom slide subassembly is assembled in a right-hand orientation, slide 2040 is attached to flange 2010 by screws 2047 inserted through holes on flange 2010 and into threaded holes 2045 and to flange 2038 by screws 2051 inserted through holes on flange 2038 and into threaded holes 2049, respectively. Slide 2042 is attached to flange 2006 by screws 2011 inserted through holes 2008 and into threaded holes 2012 and to flange 2036 by screws into threaded holes on outer rail 2056, respectively.

Rear support bracket 2090 and front support bracket 2092 are attached to inner rails 2048 and 2060 in the same manner as in the left-hand orientation. Damper engagement bracket 2072 is attached to inner rail 2048 by screws 2068 inserted through hole 2074 and slots 2076 and 2078 into threaded holes 2069.

Spring damper assembly 2084 is attached to step 2016 by screws 2086 through holes 2085 and into threaded holes 2018 and to step 2024 by screws 2088 through holes 2087 and into threaded holes 2030.

Referring to FIGS. 18 and 20, installation of bottom slide subassembly to carcass floor 1806 will be further described. To attach bottom slide subassembly 1802 from above carcass floor 1806, screws 1808 are inserted through holes 2031 and 2034 on front base bracket 2004 and through holes 2023 and 2022 on rear base bracket 2002. The screws are then threaded directly into carcass floor 1806. To attach bottom slide subassembly 1802 from under carcass floor 1806, bolts 1812 are inserted through washers 1810 and through holes 1814 into threaded holes 2026 and 2033 on front base bracket 2004 and threaded holes 2020 and 2021 on rear base bracket 2002.

Figure 21A:
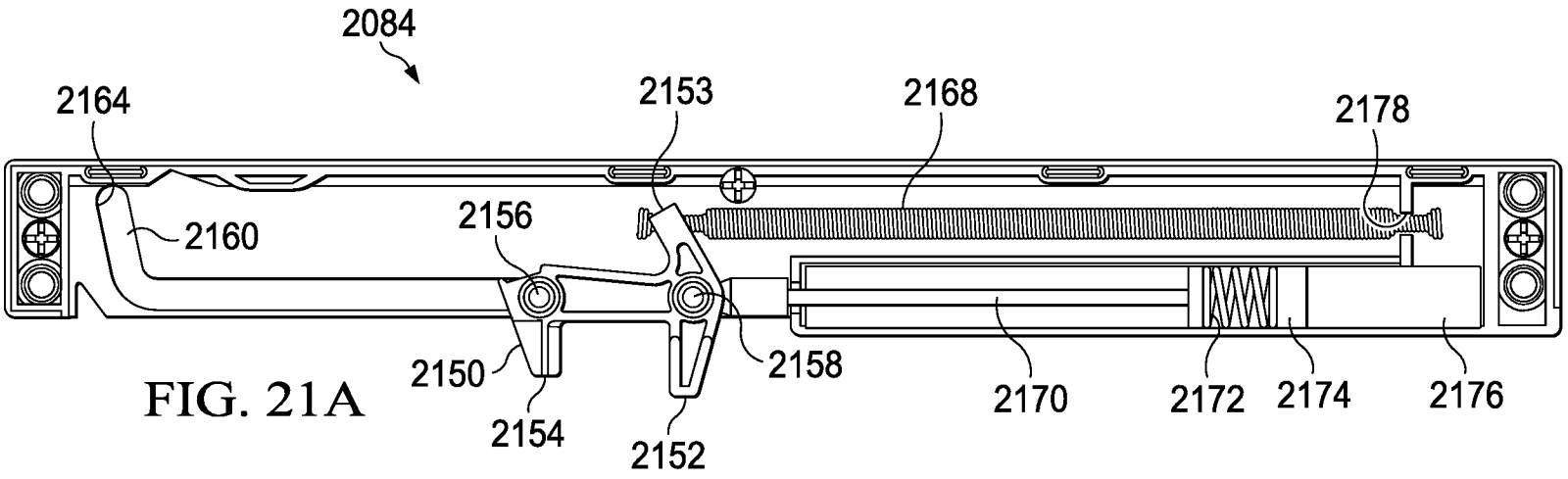
FIG. 21A is an isometric view of the underside of a spring damper assembly in a closed position.
Figure 21B:
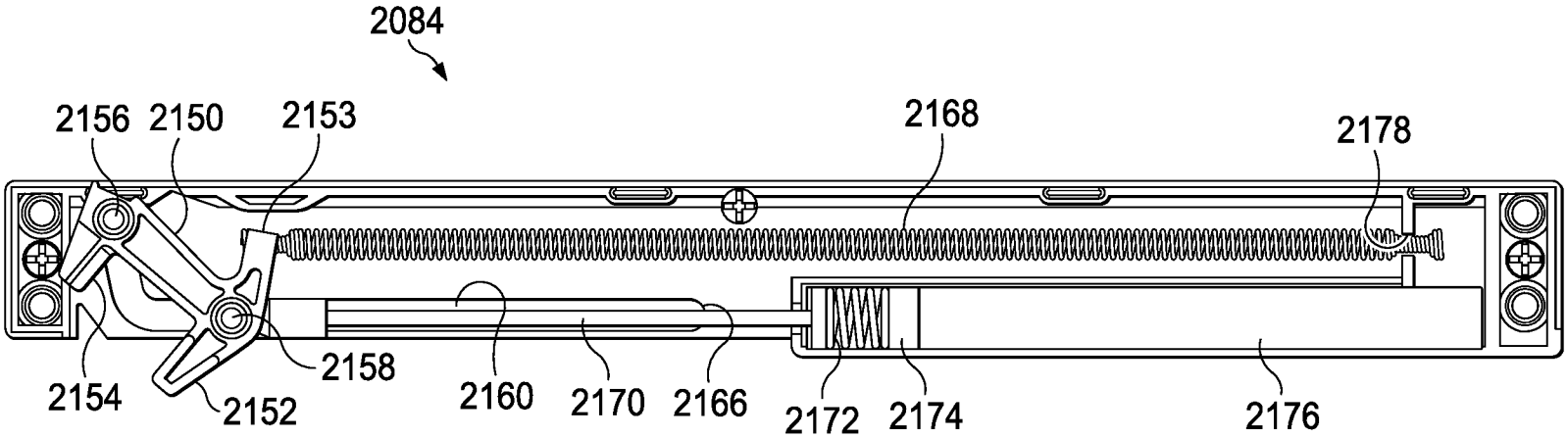
FIG. 21B is an isometric view of the underside of a spring damper assembly in an open position.

Referring to FIGS. 21A and 21B, spring damper assembly 2084 will be further described. Spring damper assembly 2084 includes damper catch 2150, roller 2156, roller 2158, spring 2168, and track 2160. Damper catch 2150 includes extensions 2152, 2153, and 2154. Roller 2156 is pivotally attached to damper catch 2150 adjacent extension 2154. Roller 2158 is pivotally attached to damper catch 2150 adjacent extensions 2152 and 2153. Spring 2168 is attached to extension 2153 and slot 2178. Rollers 2156 and 2158 are constrained by and move within track 2160. Track 2160 includes forward end 2164 and rear end 2166. Piston rod 2170 is attached to roller 2158 and piston 2174. Piston 2174 includes a series of axially aligned through holes (not shown) for passage of damping fluid. Recoil spring 2172 is seated around piston rod 2170 adjacent piston 2174. Piston rod 2170 and piston 2174 are resident in damping cylinder 2176. Damping cylinder 2176 is operably filled with a damping fluid which slows the movement of the piston in a controlled fashion.

Referring to FIGS. 20, 21A, and 21B, as the cabinet pullout is moved to the deployed position, damper catch 2150 is positioned with roller 2156 and extension 2154 adjacent forward end 2164. Spring 2168 is in an extended position. In its extended position, spring 2168 biases roller 2156 against track 2160. Piston rod 2170 is in a forward position within damping cylinder 2176. As the cabinet pullout is moved to the stowed position, stop flange 2080 abuts extension 2152 and rotates damper catch 2150 into track 2160 until extension 2154 is positioned inside recess 2082. Damper catch 2150 is moved within track 2160 by spring 2168, and slowed by piston 2174, until extension 2152 and roller 2158 is positioned adjacent rear end 2166. Steps 2016 and 2024 elevate spring damper assembly 2084 to allow stop flange 2080 to pass over front base bracket 2004 when the cabinet pullout is moved between the deployed position and the stowed position.

Figure 22:
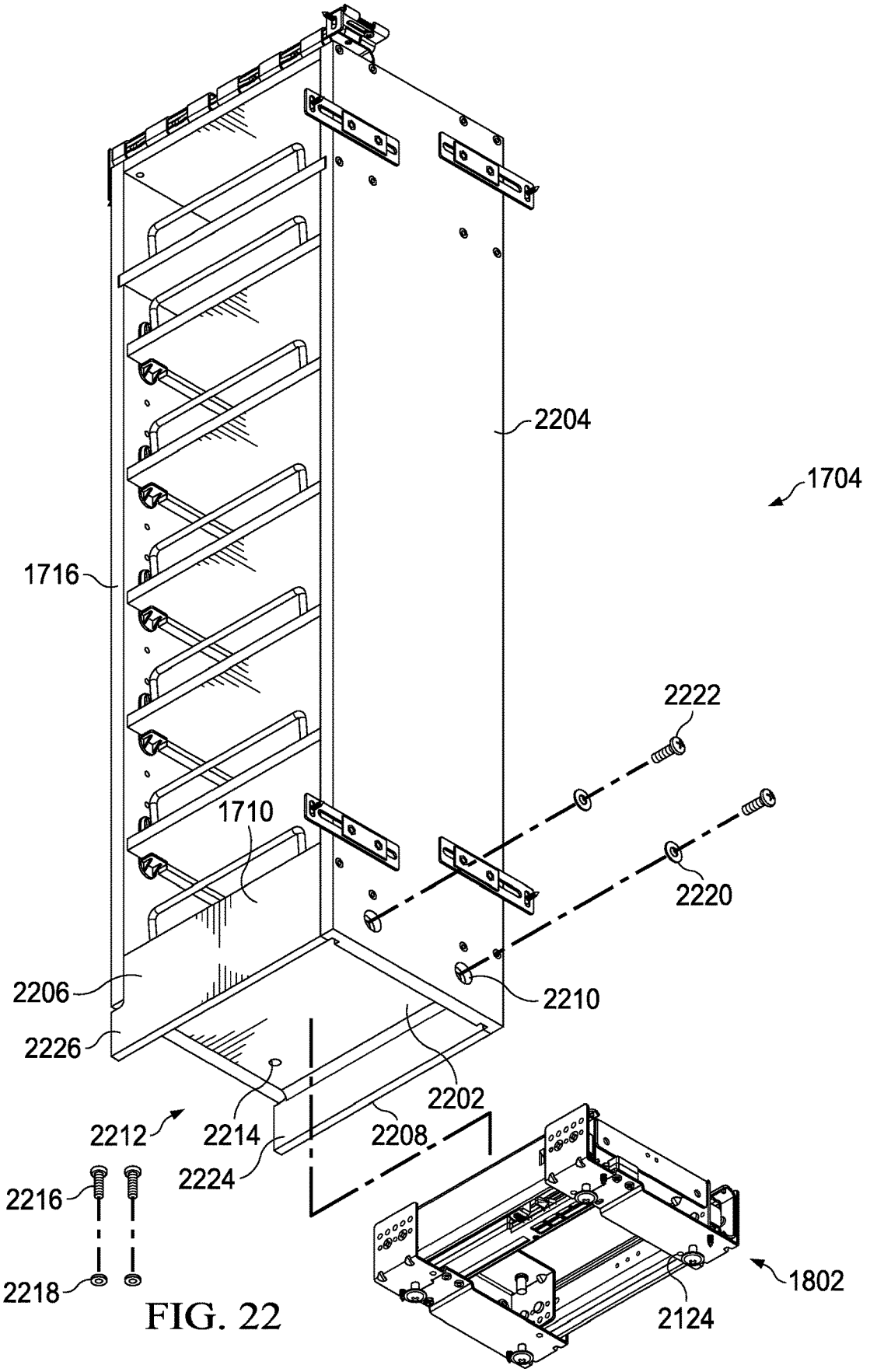
FIG. 22 is an exploded isometric view of a bottom slide subassembly and the concealment box.

Referring to FIG. 22, concealment box 1710 will be further described. Concealment box 1710 includes bottom panel 2202, side panel 2206 and side panel 2208. The bottom panel, along with front panel 2204 and side panels 2206 and 2208, form recess 2212. Bottom panel 2202 is attached to back panel 1716 and front panel 2204 preferably by a plurality of screws or a suitable adhesive. Bottom panel 2202 includes holes 2214. Side panel 2206 includes extension 2226. Side panel 2208 includes extension 2224. Side panel 2206 and side panel 2208 are attached to front panel 2204, back panel 1716, and bottom panel 2202 by a plurality of screws or a suitable adhesive. Back panel 1716 is positioned to be above extensions 2226 and 2224. Front panel 2204 includes holes 2210.

Referring to FIGS. 20 and 22, when the cabinet pullout is assembled, bottom slide subassembly 1802 is positioned inside recess 2212. Bottom slide subassembly 1802 is attached to bottom panel 2202 by screws 2216 and washers 2218 inserted through holes 2214 and into threaded holes 2104 and 2106. Front panel 2204 is attached to bottom slide subassembly 1802 by screws 2222 and washers 2220 inserted through holes 2210 into threaded holes 2124. Side panels 2206 and 2208 and front panel 2204 conceal bottom slide subassembly 1802 from view in both the stowed and deployed positions.

Figure 23:
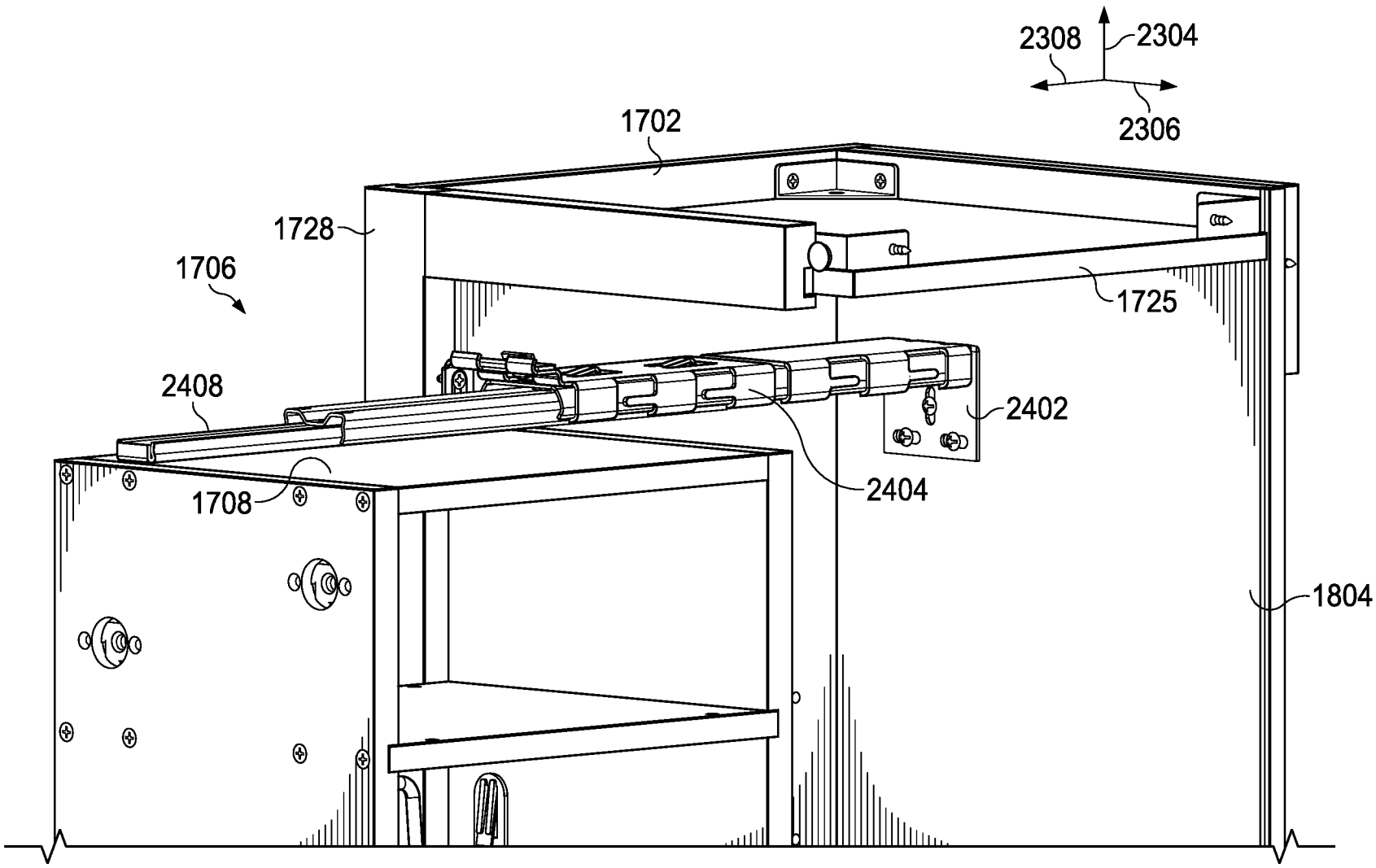
FIG. 23 is an isometric view of a cutaway of a top slide subassembly attached to the cabinet carcass and pullout top.

Referring to FIG. 23, top slide subassembly 1706 will be further described. Top slide subassembly 1706 includes upper slide 2408, front bracket 2404, and rear bracket 2402. Upper slide 2408 is removably mounted to back wall 1804 by rear bracket 2402. Upper slide 2408 is removably mounted to face frame 1728 by front bracket 2404. Rear bracket 2402 and front bracket 2404 provide positional adjustability of upper slide 2408 in three directions, vertical direction 2304, horizontal direction 2306 and depth direction 2308.

Figure 24:
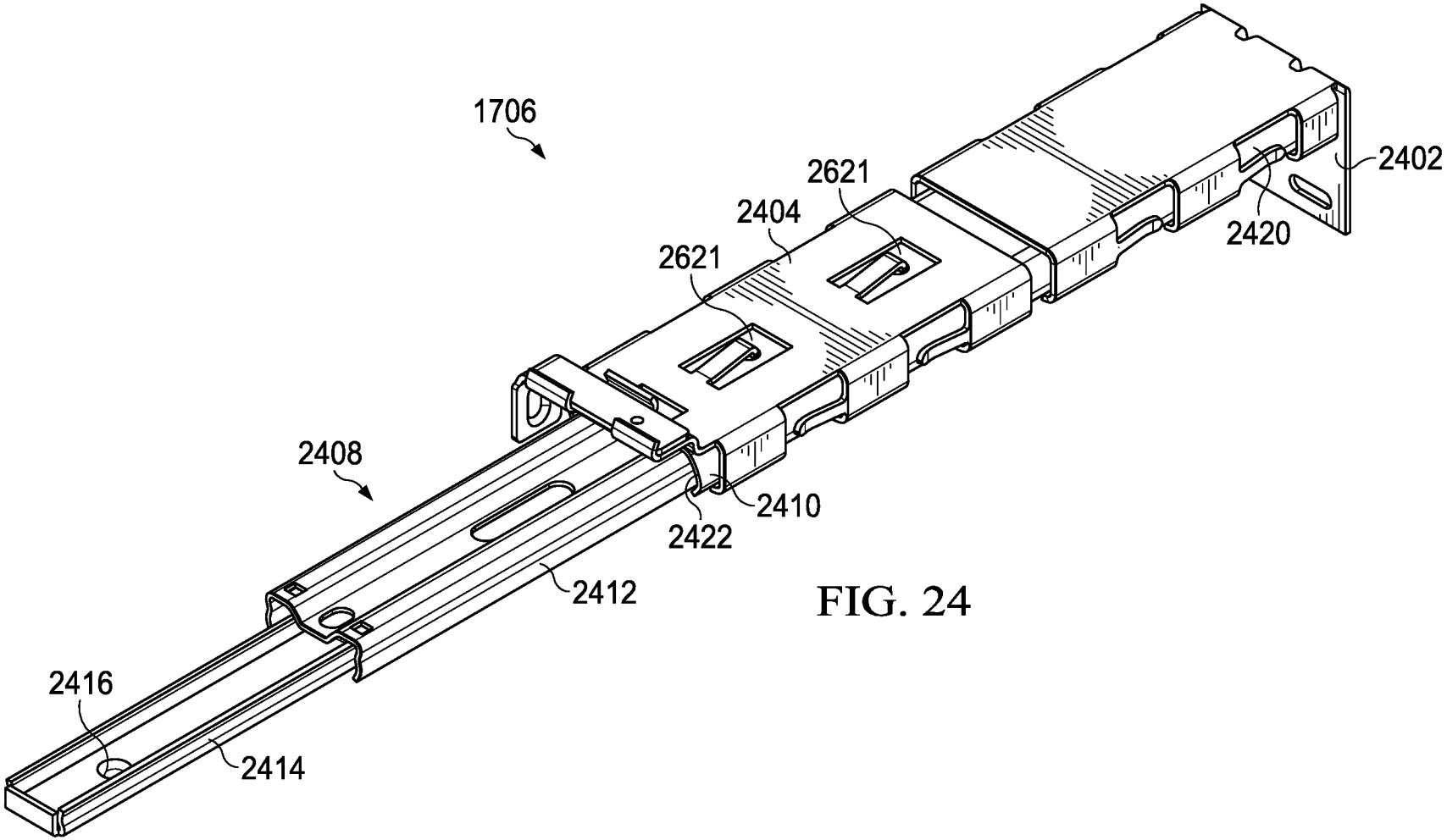
FIG. 24 is a partially exploded isometric view of a top slide subassembly.

Referring to FIG. 24, upper slide 2408 is horizontally oriented in the top of the carcass so as to reduce the clearance required between pullout top 1708 and carcass top 1725 and to reduce the moment load on the lower slides when the pullout sustains a side impact loading at the top while in the deployed position. The upper slide further contributes to side-to-side stability as the pullout is moved between deployed and stowed positions. Upper slide 2408 comprises outer rail 2410 telescopically engaged with intermediate rail 2412, and intermediate rail 2412 telescopically engaged with inner rail 2414. Outer rail 2410 has forward end 2422 and rear end 2420. Front bracket 2404 adjustably engages outer rail 2410 at forward end 2422. Rear bracket 2402 adjustably engages outer rail 2410 at rear end 2420. Inner rail 2414 includes holes 2416 for mounting to pullout top 1708 by screws. Outer rail 2410 includes mounting holes 2621 for adjustable engagement with front bracket 2404, as will be further described. The rails are connected by linear bearings (not shown) positioned in linear bearing races which enable the telescoping movement between them.

In a preferred embodiment, front bracket 2404 is symmetrical so as to allow connection to the adjustable angle bracket from either left or right side, thereby allowing mounting of the upper slide on either the left of the cabinet carcass, as shown in FIG. 24, or the right-hand of the cabinet carcass. The capability to position the upper slide on the left or right is important so as to accommodate various configurations of cabinet carcasses.

Figure 25:
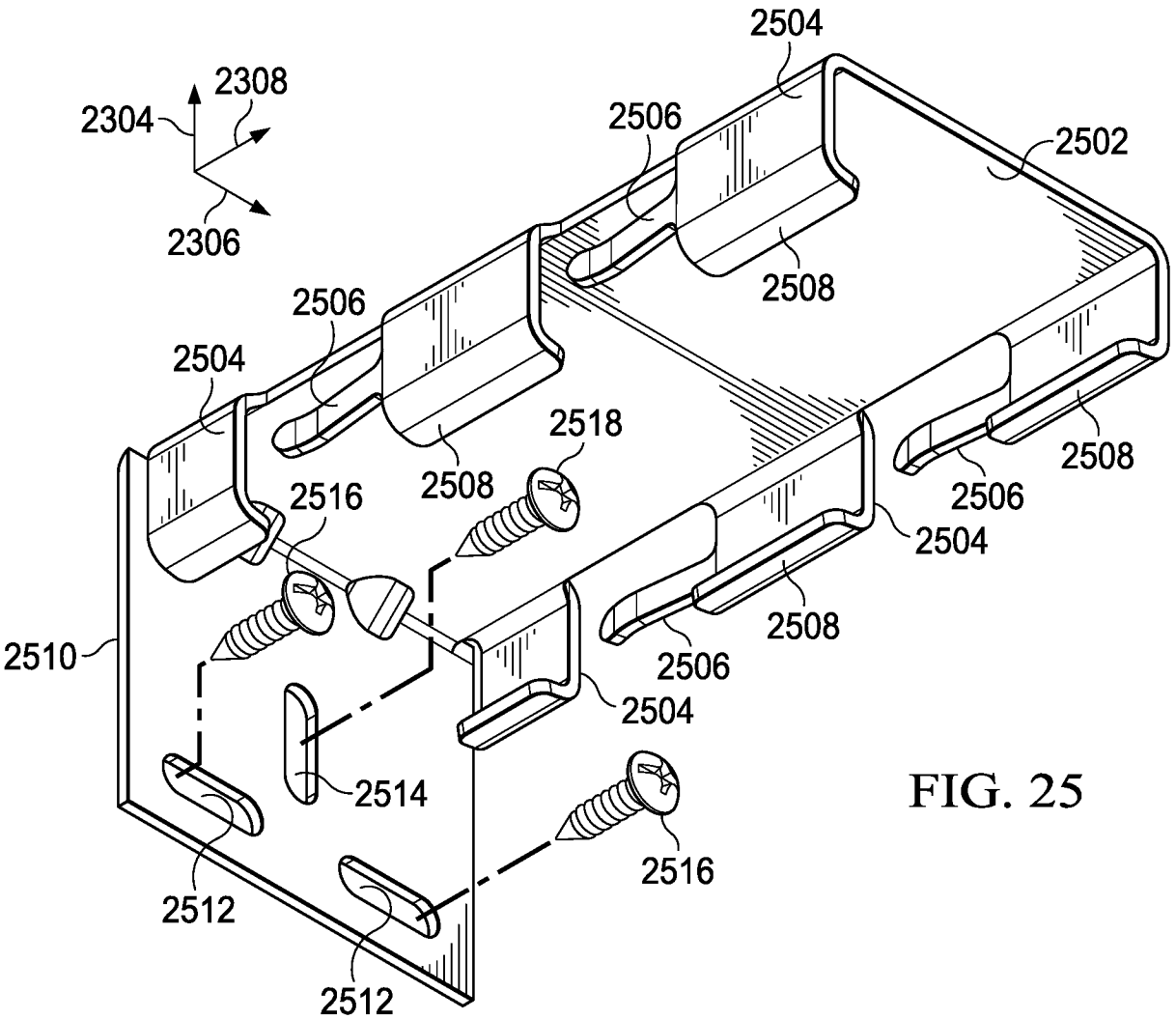
FIG. 25 is an exploded view of a back bracket.

Referring to FIG. 25, rear bracket 2402 will be further described. Rear bracket 2402 has web 2502 and flange 2510. Web 2502 is integrally formed with downwardly oriented receiver flanges 2504. Locking tabs 2506 extend from receiver flanges 2504. Locking tabs 2506 are inwardly disposed toward web 2502 and provide an inward spring bias. Receiver flanges 2504 include inwardly oriented retainer tabs 2508. Flange 2510 extends generally downwardly and generally perpendicularly from web 2502. Flange 2510 includes mounting slots 2512 and slot 2514. Slots 2512 are preferably horizontal and coaxial with each other and generally parallel to web 2502. Slot 2514 is preferably vertical and generally perpendicular to web 2502.

In use, rear bracket 2402 releasably engages outer rail 2410. Retainer tabs 2508 abut and extend around outer rail 2410. Locking tabs 2506 abut outer rail 2410 and position outer rail 2410 centrally between receiver flanges 2504. The inward bias of locking tabs 2506 secures outer rail 2410 in place longitudinally yet allows rear bracket 2402 to be removed and accommodate different widths of outer rail 2410. Rear bracket 2402 is mounted to back wall 1804 by screw 2518 through slot 2514 and screws 2516 through slots 2512. Rear bracket 2402 provides positional adjustability of upper slide 2408 at rear end 2420 in vertical direction 2304 by screw 2518 along slot 2514, in horizontal direction 2306 by screws 2516 along slot 2514, and in depth direction 2308 by locking tabs 2506 frictionally engaging outer rail 2410.

Figure 26:
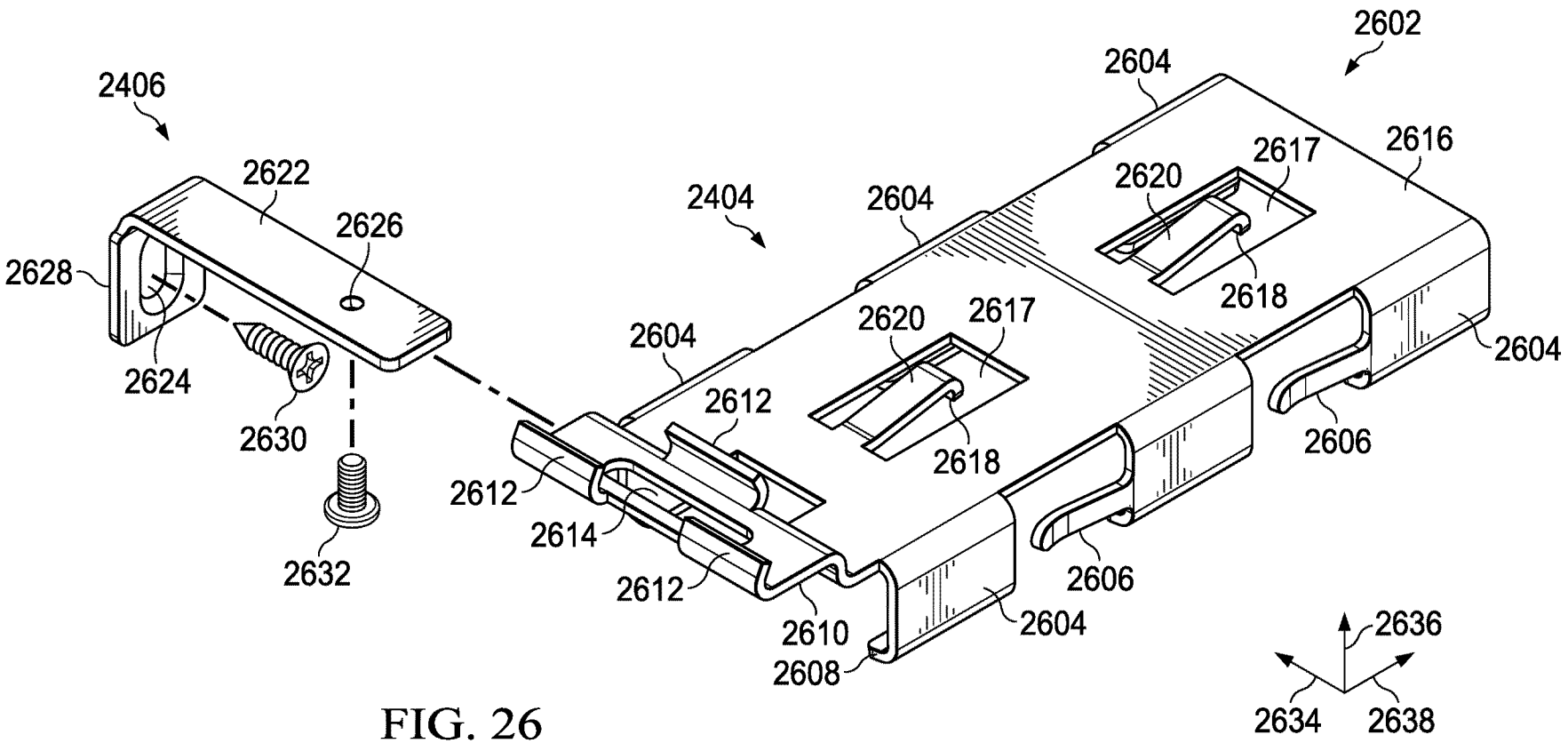
FIG. 26 is an exploded view of a side bracket.

Referring to FIG. 26, front bracket 2404 will be further described. Front bracket 2404 includes body 2602 and angle bracket 2406. Body 2602 includes web 2616 integrally formed with retainer flanges 2604. Retainer flanges 2604 extend generally downwardly and generally perpendicularly from web 2616. The retainer flanges include generally horizontal inward facing retainer tabs 2608. Spring biased locking tabs 2606 extend longitudinally from retainer flanges 2604. Spring biased locking tabs 2606 are inwardly disposed toward web 2616 such that they provide an inward bias. Upper locking tabs 2620 are integrally formed with web 2616 and protrude downwardly through access holes 2617. Each upper locking tab 2620 includes hook 2618 sized to engage rectangular mounting holes on outer rail 2410 in order to removably secure it in position.

Flange 2610 is integrally formed with and extends upwardly from body 2602. Flange 2610 includes inwardly curved, upwardly facing receiver flanges 2612 which are sized to adjustably receive horizontal flange 2622 of angle bracket 2406. Flange 2610 includes horizontal slot 2614.

Adjustable angle bracket 2406 includes horizontal flange 2622 extending generally perpendicularly from vertical flange 2628. Horizontal flange 2622 is generally rectangular and sized to slide within upwardly facing receiver flanges 2612. Horizontal flange 2622 includes threaded hole 2626. Vertical flange 2628 is generally rectangular and includes vertical slot 2624. In the left-hand orientation, horizontal flange 2622 enters upwardly facing receiver flanges 2612 from the left. In the right-hand orientation, horizontal flange 2622 enters upwardly facing receiver flanges 2612 from the right.

Referring to FIGS. 24 and 26, retainer flanges 2604 extend around outer rail 2410. Spring biased locking tabs 2606 contact and apply an inward bias to outer rail 2410 and secure it in place. Spring biased locking tabs 2606 allow front bracket 2404 to accommodate a range of widths of outer rail 2410. Hooks 2618 engage mounting holes on outer rail 2410 and removably secure it in place. Horizontal flange 2622 slides within upwardly facing receiver flanges 2612 of flange 2610. Bolt 2632 passes through slot 2614 and engages threaded hole 2626. Bolt 2632 and threaded hole 2626 adjustably secure horizontal flange 2622 to flange 2610. Angle bracket 2406 is adjustably mounted to face frame 1728 with screw 2630 through slot 2624. Front bracket 2404 provides positional adjustment of upper slide 2408 at forward end 2422 in three directions. Upper slide 2408 can be adjusted vertically in direction 2636 via screw 2630 along slot 2624. Upper slide 2408 can be adjusted horizontally in direction 2634 via bolt 2632 along slot 2614. Upper slide 2408 can be adjusted in depth direction 2638 via hooks 2618 releasably engaging mounting holes on outer rail 2410 with spring biased locking tabs 2606 frictionally engaging outer rail 2410.

Figure 27:
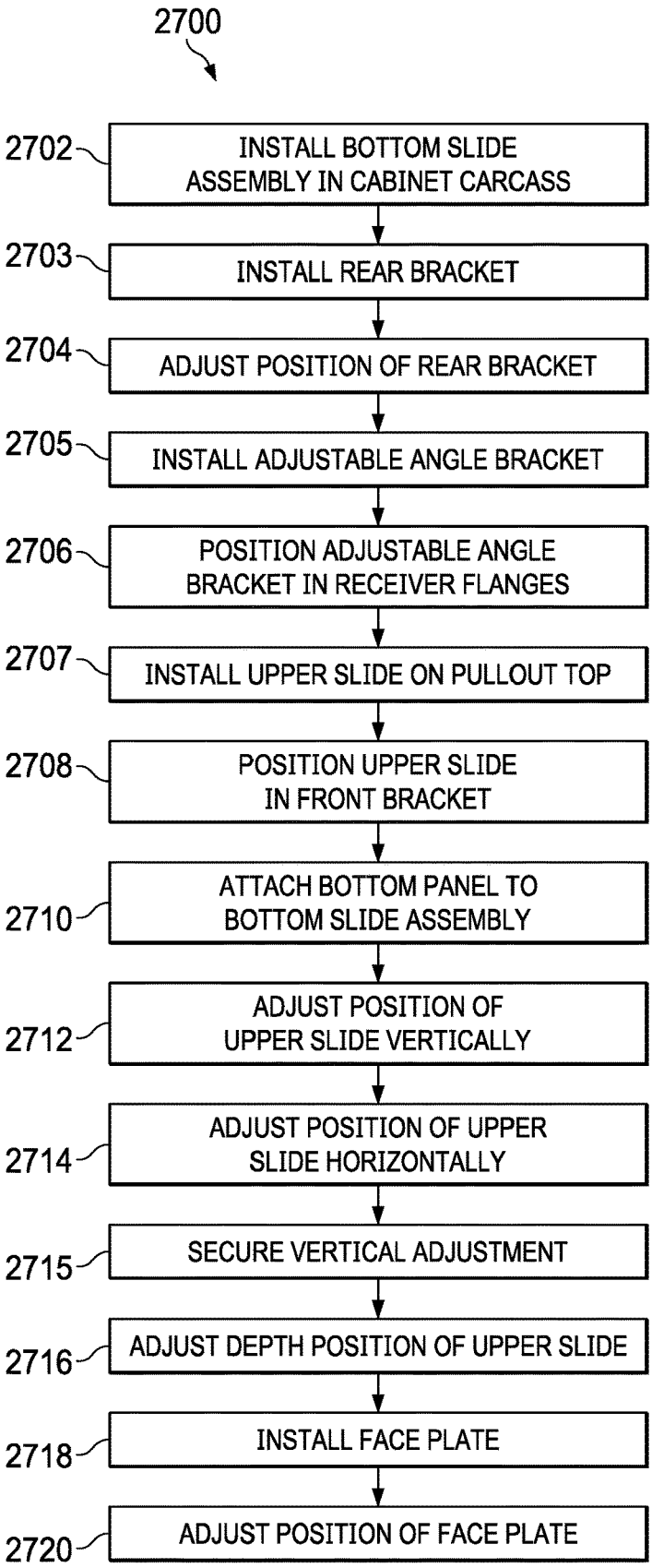
FIG. 27 is a flowchart of a preferred embodiment of a method of installation.

Referring to FIG. 27, method 2700 of installing cabinet pullout 1704 will be further described.

At step 2702, bottom slide subassembly 1802 is installed on carcass floor 1806 of cabinet carcass 1702, as previously described.

At step 2703, rear bracket 2402 is installed on back wall 1804.

At step 2704, the position of the rear bracket is adjusted. The rear of upper slide 2408 is adjusted vertically by loosening screw 2518 and sliding screw 2518 along slot 2514. The rear of upper slide 2408 is adjusted vertically by loosening screws 2516 and sliding screws 2516 along slots 2512.

At step 2705, adjustable angle bracket 2406 is installed on face frame 1728.

At step 2706, horizontal flange 2622 is positioned in upwardly facing receiver flanges 2612.

At step 2707, upper slide 2408 is installed on pullout top 1708.

At step 2708, upper slide 2408 is positioned in front bracket 2404 and rear bracket 2402.

At step 2710, bottom slide subassembly 1802 is attached to bottom panel 2202 and front panel 2204, thereby concealing the bottom slide subassembly in concealment box 1710.

At step 2712, the position of the front of upper slide 2408 is adjusted vertically by loosening screw 2630 of angle bracket 2406 and sliding screw 2630 along slot 2624.

At step 2714, the position of the front of upper slide 2408 is adjusted horizontally by loosening bolt 2632 and sliding it along slot 2614.

At step 2715, when the proper vertical position is achieved, bolt 2632 is tightened.

At step 2716, the depth of upper slide 2408 is adjusted by sliding upper slide 2408 within receiver flanges 2504. The slide is held in position by upper locking tabs 2620 within mounting holes 2621 in outer rail 2410.

At step 2718, face plate 1714 is installed on front panel 2204.

At step 2720, face plate 1714 is adjusted as described in U.S. Pat. No. 10,251,480 to Chen, incorporated herein by reference.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

The invention claimed is:

1. A concealed apparatus for slidably mounting a cabinet pullout in a cabinet carcass comprising:

a drawer box comprising a pullout top, a pullout front, and a pullout bottom connected to a first side and a second side;

the pullout bottom, the first side, the second side, and the pullout front forming a concealment recess;

a first longitudinal linear slide, comprising a first outer rail and a first inner rail;

a second longitudinal linear slide, comprising a second outer rail and a second inner rail;

a set of latitudinal base brackets attached to the cabinet carcass and to the first outer rail and the second outer rail;

a set of latitudinal attachment brackets, attached to the first inner rail and the second inner rail, and to the pullout bottom;

a longitudinal linear upper slide fixed to the pullout top;

a set of upper mounting brackets, adjustably attached to the cabinet carcass and releasably attached to the longitudinal linear upper slide; and, wherein the first longitudinal linear slide, the second longitudinal linear slide, the set of latitudinal base brackets and the set of latitudinal attachment brackets are concealed in the concealment recess.

2. The concealed apparatus of claim 1 wherein:

the first longitudinal linear slide and the second longitudinal linear slide are vertically oriented; and, the longitudinal linear upper slide is horizontally oriented.

3. The concealed apparatus of claim 1 wherein:

the set of latitudinal attachment brackets further comprises a first attachment bracket and a second attachment bracket;

the first attachment bracket further comprises a front facing flange; and, the front facing flange is attached to the pullout front.

4. The concealed apparatus of claim 1 further comprising:

a spring damper attached to the set of latitudinal base brackets; and, a releasable connection flange attached to the first inner rail, aligned to operatively engage the spring damper.

5. The concealed apparatus of claim 4 wherein the set of latitudinal base brackets is reversable, into one of a left-hand position and a right-hand position.

6. The concealed apparatus of claim 4 wherein the set of latitudinal base brackets further comprises a first base bracket and a second base bracket.

7. The concealed apparatus of claim 6 further comprising:

a first raised web portion, located on the first base bracket;

a second raised web portion, aligned with the first raised web portion, located on the second base bracket; and, wherein the spring damper is operatively attached to the first raised web portion and the second raised web portion.

8. The concealed apparatus of claim 7 wherein the spring damper is positioned in one of a left-hand orientation and a right-hand orientation.

9. The concealed apparatus of claim 1 wherein the set of upper mounting brackets is adjustable, relative to the cabinet carcass, in at least three directions.

10. The concealed apparatus of claim 9 wherein the set of upper mounting brackets further comprises a rear bracket, a front bracket, and an angle bracket.

11. The concealed apparatus of claim 10 wherein:

the front bracket further comprises a set of receiver flanges;

the angle bracket is slidably engaged with the set of receiver flanges; and, the angle bracket is adjustable in at least two directions.

12. The concealed apparatus of claim 11 wherein:

the rear bracket further comprises a first set of receiver flanges;

the front bracket further comprises a second set of receiver flanges; and, the first set of receiver flanges and the second set of receiver flanges engage the longitudinal linear upper slide.

13. The concealed apparatus of claim 12 wherein:

the first set of receiver flanges further comprises a first set of biased locking tabs;

the second set of receiver flanges further comprises a second set of biased locking tabs; and, the first set of biased locking tabs and the second set of biased locking tabs engage the longitudinal linear upper slide.

14. The concealed apparatus of claim 13 wherein:

the front bracket further comprises a flexible hook;

the longitudinal linear upper slide further comprises a set of mounting holes; and, the flexible hook engages the set of mounting holes.

15. The concealed apparatus of claim 1 wherein the drawer box further comprises a plurality of adjustable shelves between the pullout top and the pullout bottom.

16. A method of concealing a slide carriage apparatus in a cabinet pullout for operational mounting in a cabinet carcass comprising:

providing a drawer box with a pullout top, a pullout bottom, a pullout front, and a concealment recess;

providing a first linear slide, having a first outer rail and a first inner rail;

providing a second linear slide, having a second outer rail and a second inner rail, providing a set of base brackets, attached to the first outer rail and the second outer rail;

providing a first set of attachment brackets, attached in a latitudinal arrangement to the pullout bottom, and the first inner rail and the second inner rail;

providing a second set of attachment brackets, wherein the second set of attachment brackets is adjustable in three directions;

providing a third linear slide, having a third outer rail and a third inner rail;

mounting the set of base brackets to the cabinet carcass;

mounting the second set of attachment brackets to the cabinet carcass;

mounting the third inner rail to the pullout top;

inserting the third outer rail in the second set of attachment brackets; and, mounting the pullout bottom to the first set of attachment brackets, thereby concealing the first linear slide, the second linear slide, the set of base brackets and the first set of attachment brackets in the concealment recess.

17. The method of claim 16 wherein the step of providing the first set of attachment brackets further comprises:

providing a first bracket and a second bracket; and, the method further comprises the step of:

mounting the pullout front to the first bracket.

18. The method of claim 17 further comprising:

providing the first bracket with a first set of receiver flanges, a first set of biased locking tabs, and a locking hook;

providing the second bracket with a second set of receiver flanges and a second set of biased locking tabs;

providing the third outer rail with a set of mounting holes;

inserting the third outer rail through the first set of receiver flanges thereby engaging the first set of biased locking tabs;

inserting the third outer rail through the second set of receiver flanges thereby engaging the second set of biased locking tabs; and, engaging the locking hook with the set of mounting holes.

19. A base slide assembly for attaching a cabinet pullout in a cabinet carcass comprising:

a set of reversable latitudinal base brackets;

a first vertically oriented, longitudinal linear slide, having a first outer rail and a first inner rail, a second vertically oriented, longitudinal linear slide, having a second outer rail and a second inner rail;

the first outer rail and the second outer rail attached to the set of reversable latitudinal base brackets;

a spring damper attached to the set of reversable latitudinal base brackets;

a connector flange, attached to the first inner rail, aligned to operatively engage the spring damper;

a first latitudinal attachment bracket and a second latitudinal attachment bracket, attached to a bottom shelf of the cabinet pullout and attached to the first inner rail and the second inner rail; and, wherein the set of reversable latitudinal base brackets can be positioned to operate in one of a right-hand position and a left-hand position.

20. The base slide assembly of claim 19 wherein:

the set of reversable latitudinal base brackets further comprises a first base bracket and a second base bracket;

a first raised web portion located on the first base bracket;

a second raised web portion, longitudinally aligned with the first raised web portion, located on the second base bracket; and, wherein the spring damper is operatively attached to the first raised web portion and the second raised web portion, in one of the right-hand position and the left-hand position.

21. The base slide assembly of claim 20 wherein:

the first latitudinal attachment bracket further comprises a first flange and a second flange;

the second latitudinal attachment bracket further comprises a third flange and a fourth flange; and, wherein each of the first flange, the second flange, the third flange, and the fourth flange, has an arrangement of holes for adjustably securing the base slide assembly in the cabinet pullout in a concealed cabinet pullout recess.

* * * * *